US009669281B2

(12) United States Patent
Jourde et al.

(10) Patent No.: US 9,669,281 B2
(45) Date of Patent: Jun. 6, 2017

(54) COMPLEMENTARY AND ADJUSTABLE PROTECTIVE SYSTEM

(75) Inventors: Bastien Jourde, Montréal (CA); Steven Sdraulig, Gatineau (CA); Martin Laberge, Montréal (CA)

(73) Assignee: ID LAB INC., Montreal, Quebec (CA)

( * ) Notice: Subject to any disclaimer, the term of this patent is extended or adjusted under 35 U.S.C. 154(b) by 1189 days.

(21) Appl. No.: 13/574,163

(22) PCT Filed: Jan. 26, 2011

(86) PCT No.: PCT/CA2011/000091

§ 371 (c)(1),
(2), (4) Date: Sep. 27, 2012

(87) PCT Pub. No.: WO2011/091514

PCT Pub. Date: Aug. 4, 2011

(65) Prior Publication Data

US 2013/0014318 A1 Jan. 17, 2013

Related U.S. Application Data

(60) Provisional application No. 61/298,474, filed on Jan. 26, 2010.

(51) Int. Cl.
*A63B 71/12* (2006.01)
*A41D 13/015* (2006.01)
(Continued)

(52) U.S. Cl.
CPC ..... *A63B 71/12* (2013.01); *A41D 13/015* (2013.01); *A63B 2071/1208* (2013.01);
(Continued)

(58) Field of Classification Search
CPC .. A41D 13/015; A41D 13/0512; A41D 13/05; A41D 13/0518; A41D 13/0153;
(Continued)

(56) References Cited

U.S. PATENT DOCUMENTS 4,507,801 A 4/1985 Kavanagh et al.
5,337,418 A 8/1994 Kato et al.
(Continued)

*Primary Examiner* — Shaun R Hurley
*Assistant Examiner* — Andrew W Sutton
(74) *Attorney, Agent, or Firm* — Merchant & Gould P.C.

(57) ABSTRACT

A protective system (1) for protecting a user during a contact sport includes an undershirt (3) and an outer shell (7). The undershirt (3) is configured to be worn by the user, and is provided with a plurality of shock-absorbing pads (5) each being shaped and sized to protect different body parts of the user, each shock-absorbing pad (5) providing a close-to-the-body protection for a corresponding body part of the user. The outer shell (7) is configured to be worn by the user, over the undershirt (3), and is provided with a plurality of impact-dispersion pads (9) each being shaped and sized to protect different body parts of the user, each impact-dispersion pad (9) providing a floating protection for a corresponding body part of the user. Shock-absorbing pads (5) of the undershirt (3) are disposed so as to be complementary to impact-dispersion pads (9) of the outer shell (7), and pads (5,9) of either one of the undershirt (3) and the outer shell (7) are selectively customizable by the user, so as to provide the user with a complementary and adjustable protective system (1).

50 Claims, 31 Drawing Sheets

(51) Int. Cl.
*A63B 102/24* (2015.01)
*A63B 102/14* (2015.01)

(52) U.S. Cl.
CPC ..... *A63B 2102/14* (2015.10); *A63B 2102/24* (2015.10); *A63B 2243/007* (2013.01)

(58) Field of Classification Search
CPC ..... A41D 13/0531; A41D 13/0562; A41D 13/0568; A41D 13/0012; A41D 13/0575; A41D 31/0044; A63B 71/12; A63B 71/0054; A63B 71/08; A63B 2071/1208; A63B 2071/0063; A63B 2243/007; A63B 2243/0025; A63B 2243/0041; A63B 2243/005
USPC ..... 2/459, 455, 463, 464, 467, 461, 462
See application file for complete search history.

(56) References Cited

U.S. PATENT DOCUMENTS 5,623,728 A * 4/1997 Wagner ..... A63B 71/12 2/16
6,141,800 A 11/2000 Regan
6,748,601 B2 6/2004 LaShoto et al.
6,966,070 B2 11/2005 Gillen et al.
7,100,216 B2 9/2006 Matechen et al.
7,748,056 B2 7/2010 Mickle
8,082,602 B2 * 12/2011 Crelinsten ..... A41D 13/05 2/267
2004/0199983 A1 10/2004 Gillen et al.
2006/0107433 A1 5/2006 Olson
2006/0205303 A1 9/2006 Nurnberg
2006/0272071 A1 12/2006 Mickle
2007/0050886 A1 3/2007 Brassill
2007/0151004 A1 7/2007 Brassill
2008/0313793 A1 12/2008 Skottheim et al.
2010/0122403 A1 5/2010 Mickle
2010/0242158 A1 9/2010 Blakely et al.
2010/0293703 A1 11/2010 Tezartes-Strauss et al.
2010/0306907 A1 12/2010 Fiegener et al.
2010/0306908 A1 12/2010 Fiegener et al.
2010/0319097 A1 12/2010 Turner
2010/0319104 A1 12/2010 Beland et al.
2011/0167548 A1 * 7/2011 Jourde ..... A41D 13/0518 2/463
2011/0247130 A1 * 10/2011 Lewandowski .... A41D 13/0153 2/459
2011/0252549 A1 * 10/2011 Jourde ..... A41D 13/0518 2/463
2012/0311769 A1 * 12/2012 Lee ..... A63B 71/12 2/272

* cited by examiner full coverage with all protective component attached to protective undershirt bridge component removed bicep inserts from protective component removed shoulder cap extension removed
More protection Step 1 : unlock Velcro tab on both sides
Step 2 : unfold Velcro loop surface on both sides
Step 3 : slide abdominal link through sleeve on both sides Step 4 : fold back Velcro loop surface on both sides
Step 5 : lock Velcro loop surface with tab on both sides Step 6 : unlock Velcro tab
Step 7 : fold abdominal flap Step 8 : slide abdominal section of frame between protective undershirt and abdominal link Step 9 : fold back abdominal flap
Step 10 : lock abdominal flap
Step 11 : attach waist bands to Velcro loop on abdominal link

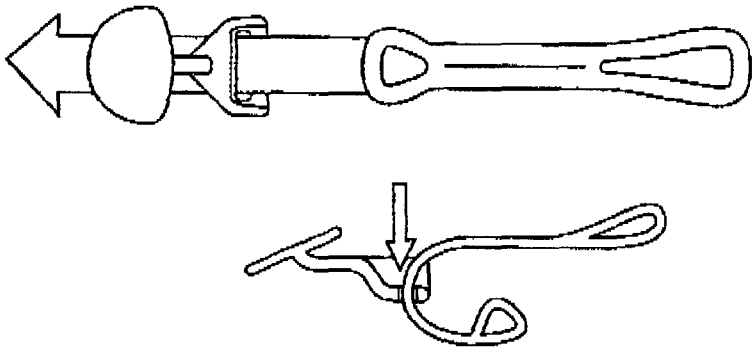
STEP 1 - insert small loop from TPU band through TPU anchor's slot (as per image above)
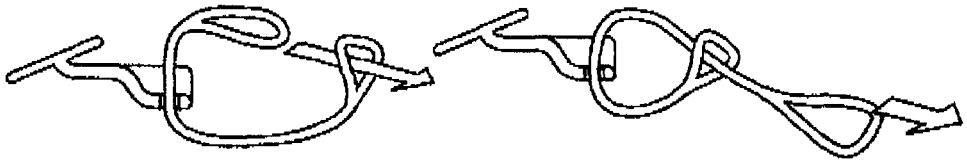
STEP 2 - insert big loop from TPU band through small loop
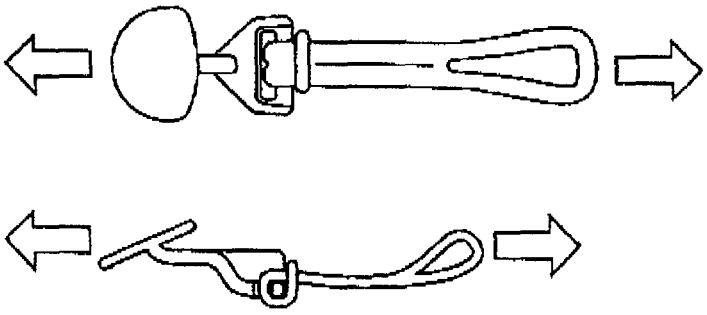
STEP 3 - pull tight on both ends to lock
FIG. 50

STEP 7 -
slide all 3 TPU anchors under rip proof overlay material and hook into Key Hole

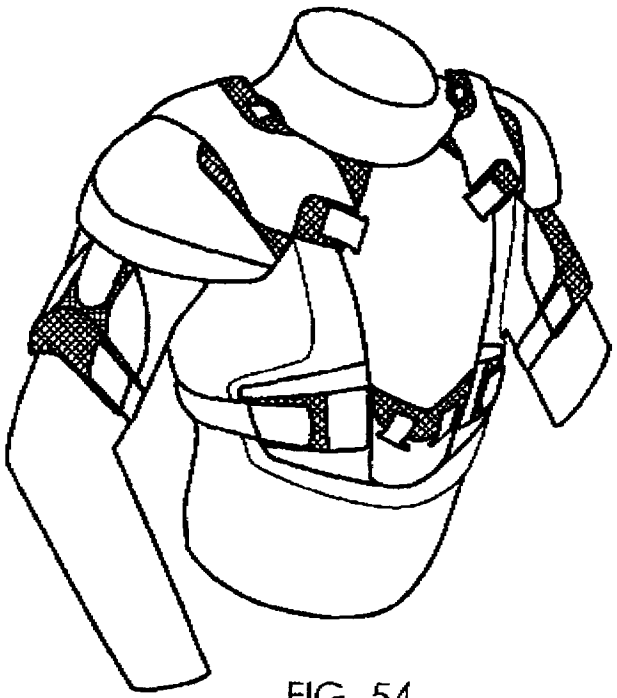

FIG. 54

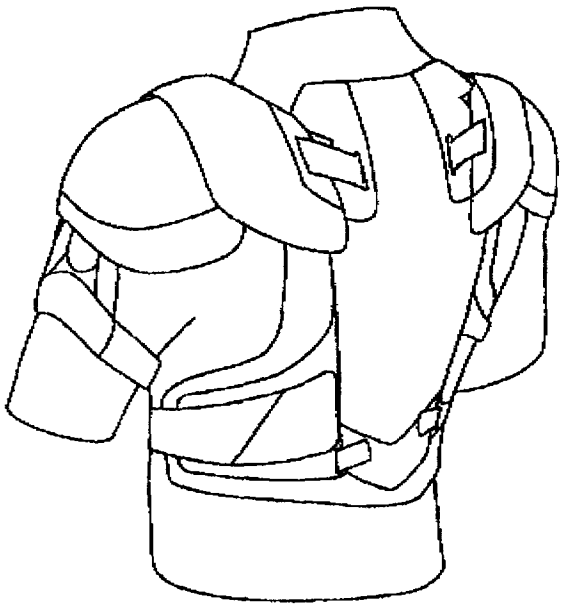

FIG. 55

1- the shoulder pad portion includes a removable base layer.
2- this removable base layer can either be a single piece covering the front and the back, or 2 separated front and back portions independantly attached to the shoulder pad.
3- this base layer is protecting the front and back portions of the upper body by offering a standart coverage, similar to standart shoulder pads on the market.
4- the shoulder pad can be worn independantely from the undershirt, offering similar coverage protection as standart shoulder pads on the market.
5- once these base layers are removed from the shoulder pad, the shoulder pad offers a reduced protection if worn alone.
6- the undershirt worn with the reduced coverage shoulder pad, forms a complementary protection system removable front base layer removable back base layer

COMPLEMENTARY AND ADJUSTABLE PROTECTIVE SYSTEM

This application is a National Stage Application of PCT/CA2011/000091, filed 26 Jan. 2011, which claims benefit of Ser. No. 61/298,474, filed 26 Jan. 2010 in the United States and which applications are incorporated herein by reference. To the extent appropriate, a claim of priority is made to each of the above disclosed applications.

FIELD OF THE INVENTION

The present invention relates to a protective system. More particularly, the present invention relates to a complementary and adjustable protective system, as well as to a kit with corresponding components for assembling the same, and to corresponding methods of assembling and using the protective system.

BACKGROUND OF THE INVENTION

Protective gear, including shoulder pads, as used in various contact sports or impact-prone disciplines, such as football, hockey, lacrosse, motocross and the like, are very well known in the art, indeed, advantages associated with these conventional shoulder pads are namely that: a) they offer essential protection in a physical impact sport; and b) they offer a recognizable design that appeal to players.

Known to the Applicant are the following US patent and patent applications which relate to such protective gear, including shoulder pads: U.S. Pat. No. 4,507,801; U.S. Pat. No. 5,337,418; U.S. Pat. No. 6,141,800; U.S. Pat. No. 6,748,601 B2; U.S. Pat. No. 6,966,070 B2; U.S. Pat. No. 7,100,216 B2; U.S. Pat. No. 7,748,056 B2; 2006/0272071 A1; 200710050886 A1; 200710151004 A1; 2008/0313793 A1; 2010/0122403 A1; 201010242158 A1; 2010/0293703 A1; 2010/0306907 A1; 201010306908 A1; 2010/0319097 A1; and 2010/0319104 A1.

Also known in the art are the various drawbacks associated with conventional protective shoulder pads, namely: a) they tend to be quite "bulky" (this is required namely to cover a wide range of body motion); b) they interfere and/or limit body motion; c) they lack protection and expose sensitive body parts when a player is in motion (e.g. shoulder blade, underarm section of ribs, etc.); d) they offer little adjustment for fit and protection; e) they retain body heat and body sweat; f) they are not optimally designed to ensure that they are maintained in place with respect to a body of a given user during the various movements thereof, given that most of conventional shoulder pads are "floating" shoulder pads; and g) they are not designed to allow a customization depending on a user's preferences or other considerations, such as a degree of protection being sought, the extent of range of motion being desired, the particular type of sport to be played and/or the particular position to be played within said sport.

Hence, in light of the aforementioned, there is a need for an improved system which, by virtue of its design and components, would be able to overcome or at least minimize some of the aforementioned prior art concerns.

SUMMARY OF THE INVENTION

The object of the present invention is to provide a protective system which satisfies some of the above-mentioned needs and which is thus an improvement over other related protective systems and/or methods known in the prior art.

In accordance with the present invention, the above object is achieved, as will be easily understood, with a complementary and adjustable protective system such as the one briefly described herein and such as the one exemplified in the accompanying drawings.

More particularly, according to the present invention, there is provided a protective system for protecting a user during a contact sport, the protective system comprising:

an undershirt configured to be worn by the user, the undershirt being provided with a plurality of shock-absorbing pads each being shaped and sized to protect different body parts of the user, each shock-absorbing pad providing a close-to-the-body protection for a corresponding body part of the user; and an outer shell configured to be worn by the user, over the undershirt, the outer shell being provided with a plurality of impact-dispersion pads each being shaped and sized to protect different body parts of the user, each impact-dispersion pad providing a floating protection for a corresponding body part of the user;

wherein shock-absorbing pads of the undershirt are disposed so as to be complementary to impact-dispersion pads of the outer shell, and wherein pads of either one of the undershirt and the outer shell are selectively customizable by a user, so as to provide the user with a complementary and adjustable protective system.

According to another aspect of the present invention, there is also provided an undershirt configured to be used with the above-mentioned protective system.

According to another aspect of the present invention, there is also provided an outer shell configured to be used with the above-mentioned protective system.

According to another aspect of the present invention, there is also provided equipment provided with the above-mentioned protective system and/or components thereof (ex. undershirt, outer shell, corresponding pads or inserts, etc.).

According to another aspect of the present invention, there is also provided a method of using the above-mentioned protective system and/or components thereof by a given user.

According to another aspect of the present invention, there is also provided a method of operating the above-mentioned protective system, components thereof and/or resulting equipment.

According to another aspect of the present invention, there is also provided a kit with corresponding components for assembling the above-mentioned protective system and/or equipment.

According to yet another aspect of the present invention, there is also provided a method of assembling components of the above-mentioned kit.

According to yet another aspect of the present invention, there is also provided a method of doing business with the above-mentioned kit, protective system, corresponding components thereof and/or resulting equipment.

The objects, advantages and other features of the present invention will become more apparent upon reading of the following non-restrictive description of preferred embodiments thereof, given for the purpose of exemplification only, with reference to the accompanying drawings.

BRIEF DESCRIPTION OF THE DRAWINGS

FIGS. 9-57 are different views of other various aspects, components and features of a protective system according to preferred embodiments of the present invention, FIGS. 10, 12, 16, 18, 20 and 24 for example showing rear views of the system.

DETAILED DESCRIPTION OF PREFERRED EMBODIMENTS OF THE INVENTION

Figure 1:
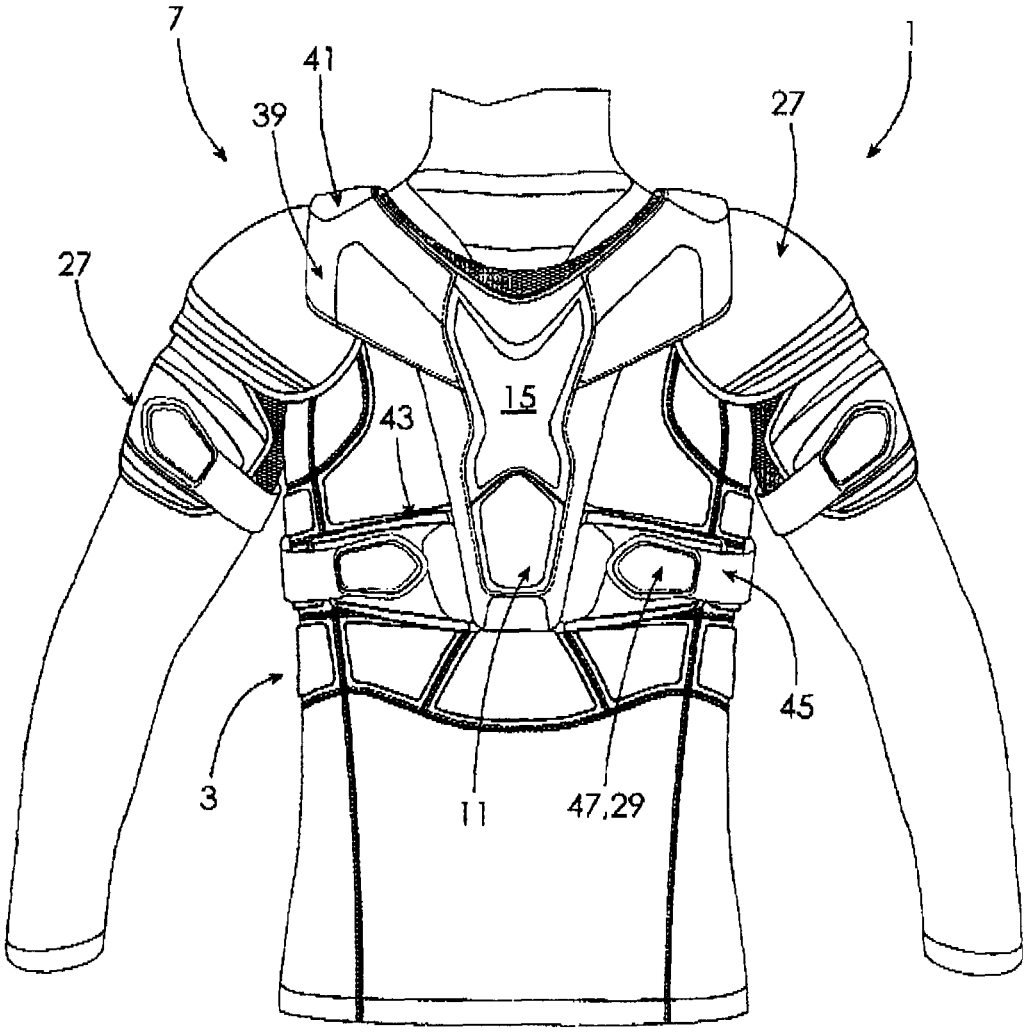
FIG. 1 is a front view of a complementary and adjustable protective system including an undershirt and an outer shell placed thereover according to a preferred embodiment of the present invention, the undershirt and outer shell being shown worn by a schematic user of the system.
Figure 2:
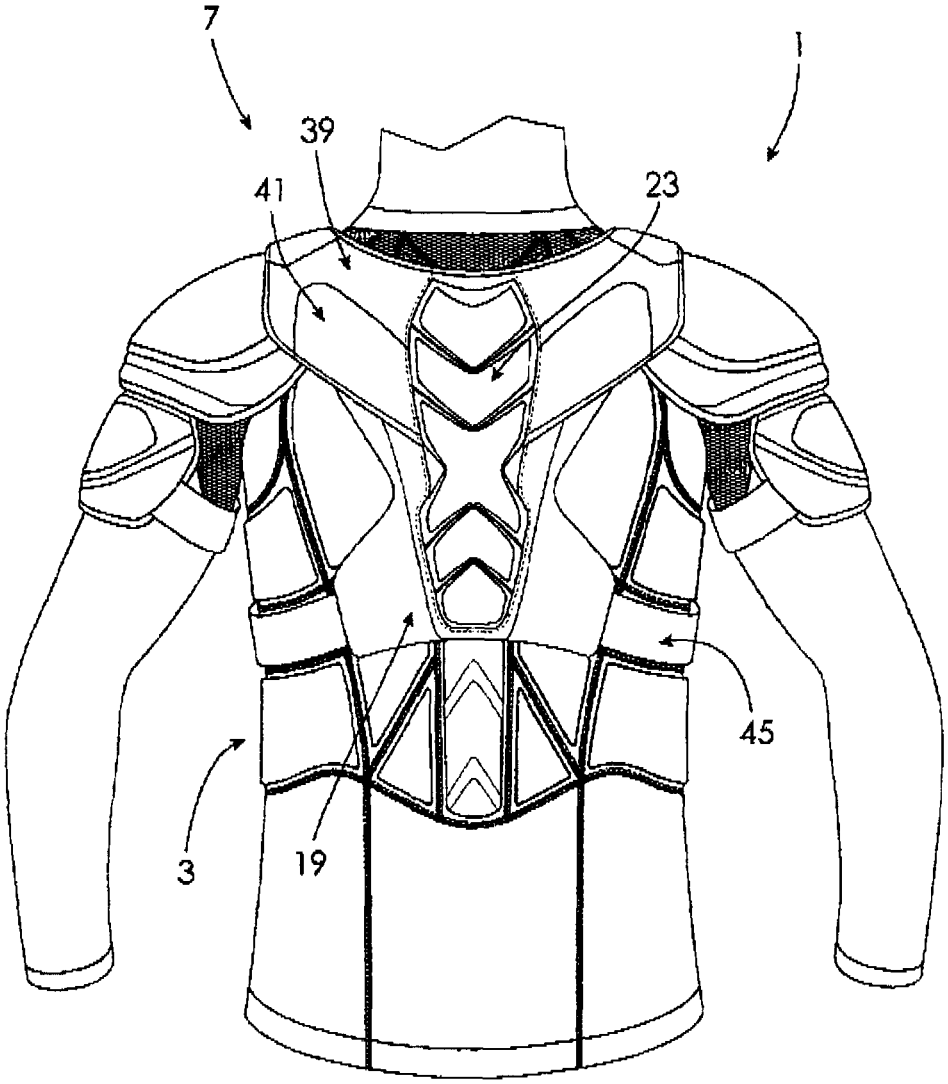
FIG. 2 is a rear view of what is shown in FIG. 1.
Figure 3:
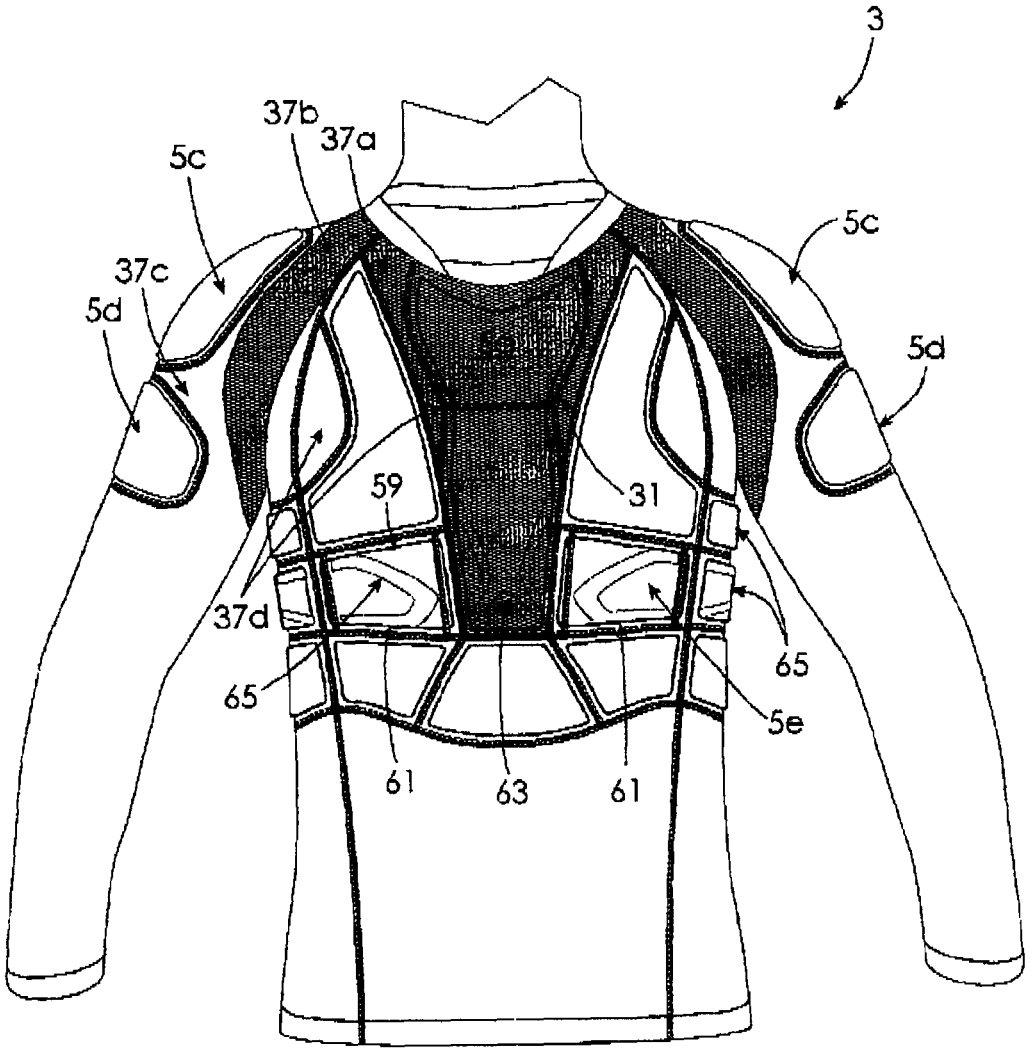
FIG. 3 is a front view of the undershirt of the protective system shown in FIG. 1.
Figure 4:
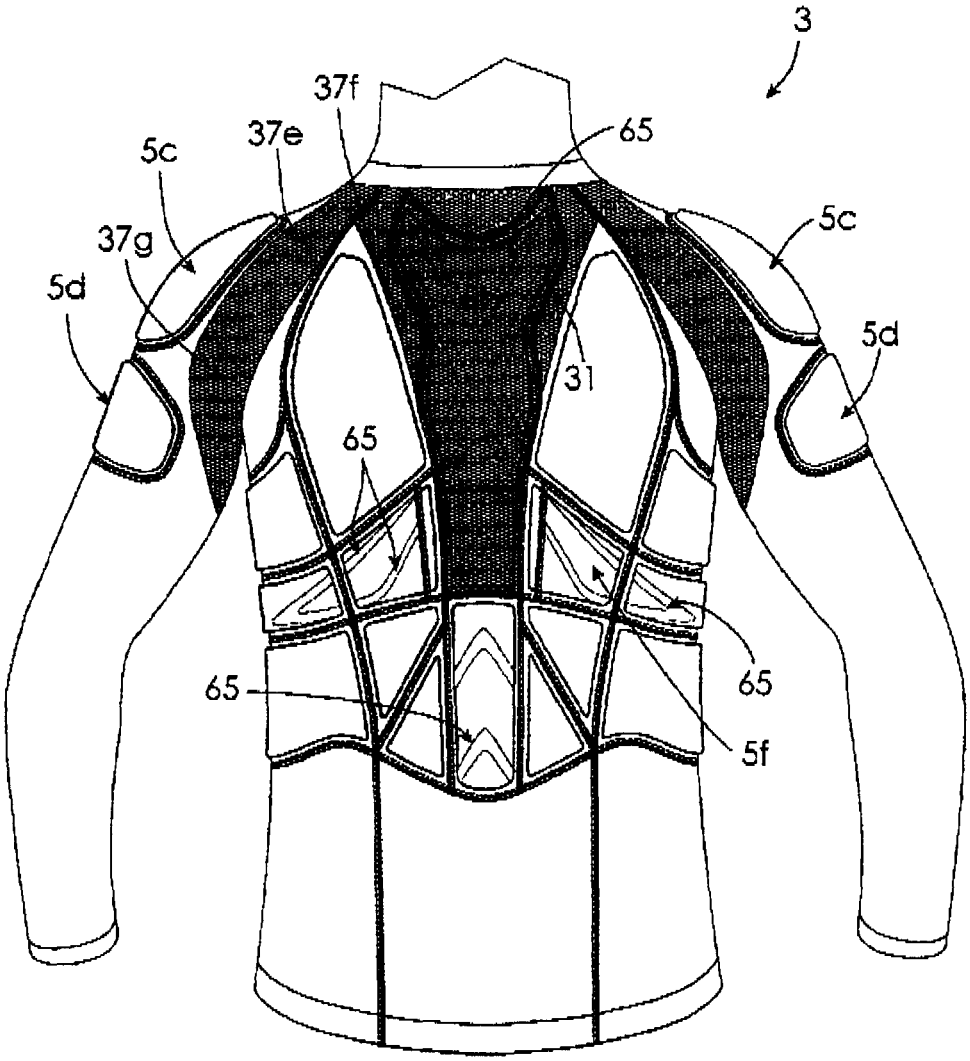
FIG. 4 is a rear view of what is shown in FIG. 3.

In the following description, the same numerical references refer to similar elements. The embodiments, geometrical configurations, materials mentioned and/or dimensions shown in the figures or described in the present description are preferred embodiments only, given for exemplification purposes only.

Moreover, although the present invention was primarily designed for protecting a player during a contact sport or an impact-prone discipline, such as football, hockey, lacrosse, motocross and the like, it may be used for other types of activities, and in other fields, for other purposes, as apparent to a person skilled in the art. For this reason, expressions such as "contact", "sport", etc., used herein should not be taken as to limit the scope of the present invention and includes all other kinds of objects or fields with which the present invention could be used and may be useful. Indeed, the present invention could be used as a professional, an industrial or a sporting protective garment, intended to offer protection against blows and/or other types of impacts.

Moreover, in the context of the present invention, the expressions "system", "gear", "equipment", "device", "assembly" and "pad", as well as any other equivalent expressions and/or compounds word thereof known in the art will be used interchangeably, as apparent to a person skilled in the art. This applies also for any other mutually equivalent expressions, such as, for example: a) "body", "part", "member", "arm" "muscle", "bone", "organ", "articulation", etc.; b) "chest", "thorax", "sternum", etc.; c) "back", "spine", etc.; d) "pad", "insert", "protector", "plate", "shield", "foam", etc.; e) "outer shell", "outer shield", "shoulder pad", etc.; f) "contact", "impact", "blow", "hit", etc.; g) "fastening", "securing", "attaching", "anchoring", "adjusting", etc.; as well as for any other mutually equivalent expressions, pertaining to the aforementioned expressions and/or to any other structural and/or functional aspects of the present invention, as also apparent to a person skilled in the art.

Furthermore, in the context of the present description, it will be considered that expressions such as "connected" and "connectable", or "mounted" and "mountable", may be interchangeable, in that the present invention also relates to a kit with corresponding components for assembling a resulting fully assembled complementary and adjustable protective system.

In addition, although the preferred embodiments of the present invention as illustrated in the accompanying drawings may comprise various components, and although the preferred embodiments of the protective system, components thereof, and resulting equipment, as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperation thereinbetween, as well as other suitable geometrical configurations may be used for the protective system, corresponding components, as well as resulting equipment, and corresponding complementary parts, according to the present invention, as will be briefly explained hereinafter and as can be easily inferred herefrom by a person skilled in the art, without departing from the scope of the invention.

Broadly described, the present invention, as illustrated in the accompanying drawings, relates to a protective system (1) for protecting a user during a contact sport, such as for example, football, hockey, lacrosse and the like, as can be easily understood by a person skilled in the art. The protective system (1) preferably comprises an undershirt (3) and an outer shell (7). The undershirt (3) is configured to be worn by the user, and is preferably provided with a plurality of shock-absorbing pads (5) each being shaped and sized to protect different body parts of the user, each shock-absorbing pad (5) providing a close-to-the-body protection for a corresponding body part of the user. The outer shell (7) is configured to be worn by the user, over the undershirt (3), and is provided with a plurality of impact-dispersion pads (9) each being shaped and sized to protect different body parts of the user, each impact-dispersion pad (9) providing a floating protection for a corresponding body part of the user. Shock-absorbing pads (5) of the undershirt (3) are disposed so as to be complementary to impact-dispersion pads (9) of the outer shell (7), and the present protective system (1) is designed, as will be explained in greater detail hereinbelow, so that pads (5,9) of either one (i.e. one or the other, or both) of the undershirt (3) and the outer shell (7) are selectively customizable by a user, so as to provide the user with a complementary and adjustable protective system (1).

Indeed, as will be better understood when referring to the following description, the present invention is advantageous in that it is a protective system (1) made of a protective undershirt (3), hereinafter referred to also as "base layer", and an outer shell (7), hereinafter referred to also as "outer pad" or "shoulder pad". The present system (1) combines the advantages of close-to-the-body protection while keeping the benefits of a floating shoulder pad. Indeed, the base layer ensures an impact absorption on stable body parts while following body motion, whereas the floating outer pad(s) transfers the impact of the base layer while keeping freedom of motion for key articulations of a user of the present system (1).

As will also be explained in greater detail hereineblow, the present invention offers various solutions in response to the drawbacks of conventional shoulder pads. Preferably, and as aforementioned, it comprises two major components, namely a protective undershirt base layer (see FIGS. 3-4 and 9-14, for example) and an outer shell (7) or "shoulder pad" (see FIGS. 5-6 and 15-20, for example). These two components can be used separately or together in order to compose a complementary and adjustable protective system. The protective undershirt base layer and the outer shell, together as a system, can be used in different ways, but preferably in three major ways or "operating modes". The first way can be defined as "complementary" (see FIG. 21, for example), where the shoulder pad is simply worn over the protective undershirt base layer. The second way can be defined as "integrated" (see FIGS. 22*a*-26, for example) because the shoulder pad is operatively attached to the user via the protective undershirt base layer. The third way can be described as being by "transposition" (see FIGS. 27-35, for example) where the protective components are removed from the modular shoulder pad and transposed directly to the protective undershirt base layer. The modular shoulder pad offers high impact floating protection where as the protective undershirt base layer offers a close-to-the-body non-obstructive protection, thus completing each other, working as a system, to offer improved protection over conventional shoulder pads.

Figure 5:
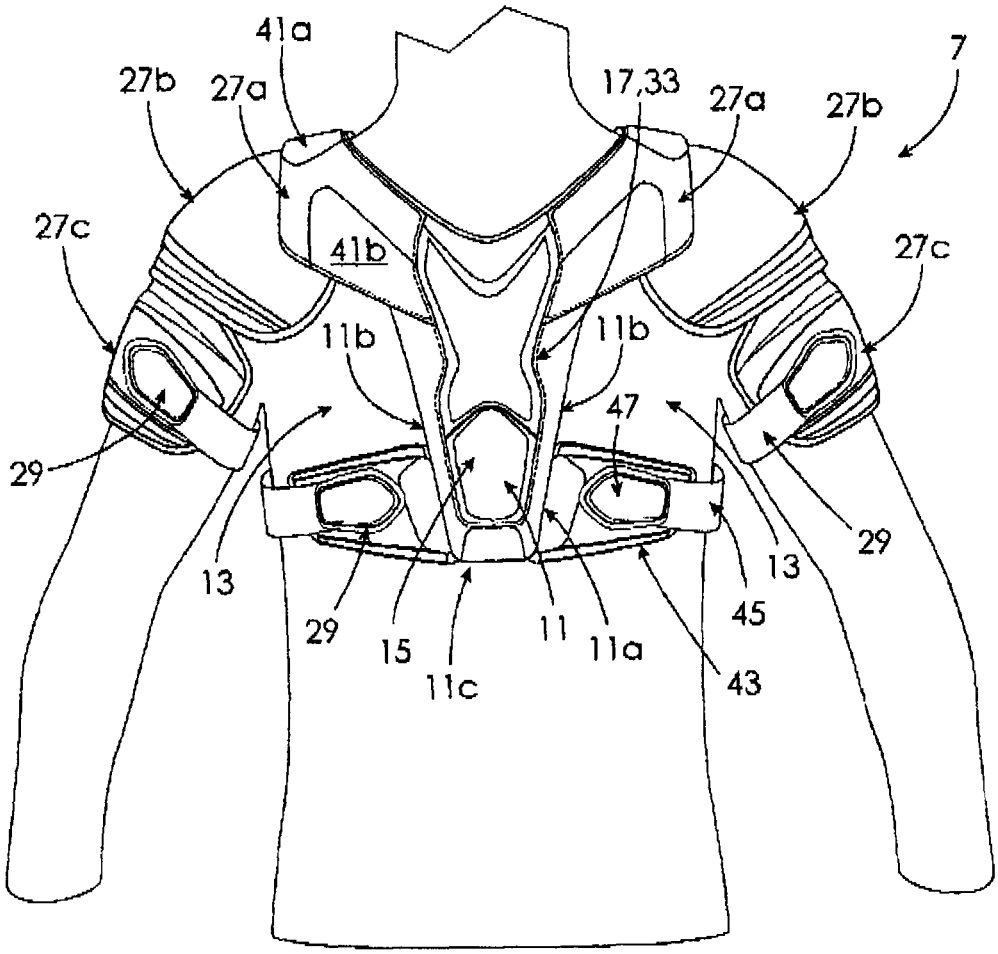
FIG. 5 is a front view of the outer shell of the protective system shown in FIG. 1, said outer shell being shown worn by a schematic user according to a preferred embodiment of the present invention.
Figure 6:
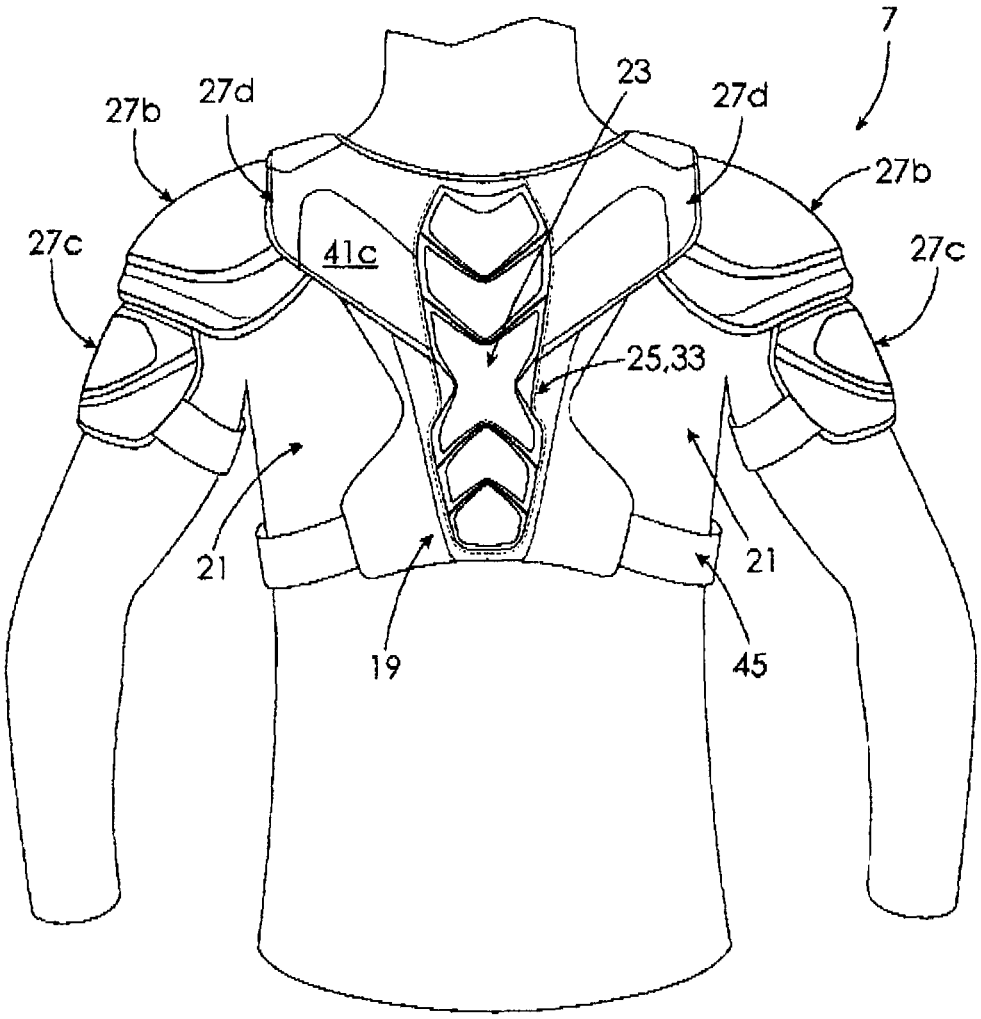
FIG. 6 is a rear view of what is shown in FIG. 5.

According to a preferred embodiment of the present invention, and as better shown in FIGS. 5 and 6, the outer shell (7) may comprise a frontal portion (11) disposed along a substantially vertical axis, and defining a pair of front opened areas (13) of the outer shell (7), each front opened area (13) being provided on a corresponding side of the frontal portion (11). These front opened areas (13) of the outer shell (7) are preferably configured so as to be disposed about pectoral areas of the user, in order to allow a range of motion of the pectoral areas of the user within said front opened areas (13) of the outer shell (7). As can be easily understood when referring to the accompanying drawings, and as will be explained in greater detail hereinbelow, the body parts of a user of the present system (1) which find themselves in the front opened areas (13) of the outer shell (7) will be protected by corresponding shock-absorbing pads (5) provided on the underlying undershirt (3), such as integrated chest pads (5*g*) for example, as better shown in FIG. 3 for example. Preferably also, the frontal portion (11) of the outer shell (7) is tapered downwardly.

In its simplest form, that is, an outer shell (7) deprived of any corresponding caps (27), such as clavicle caps (27*a*), shoulder caps (27*b*), bleep caps (27*c*), frontal and rear portions (11,13) of the outer shell (7) are preferably substantially V-shaped, as exemplified in FIGS. 41-46, for example. It is worth mentioning however that, even with such corresponding caps (27), the frontal portion (11) of the outer shell (7) still preferably comprises a portion that is substantially V-shaped, as better shown in FIG. 5, for example. In the event that the protective system (1), and more particularly the outer shell (7) thereof, is provided with complementary caps (27), such as clavicle caps (27*a*) for example, the frontal portion (11) of the outer shell (7) may be substantially T-shaped, as also shown in FIG. 5. It is worth mentioning however, as can be easily understood by a person skilled in the art, that the outer shell (7), and the frontal portion (11) thereof, may take on various other configurations, shapes and forms, depending on the particular applications for which the protective system (1) is intended for, and the desired end results, as apparent to a person skilled in the art.

Irrespectively of these various different embodiments, the frontal portion (11) of the outer shell (7) preferably comprises an outer sternum shield (15), or some sort of front chest protection, as can be easily understood by a person skilled in the art when referring to the accompanying drawings.

As previously explained, the present protective system (1) is meant to be customizable, in various different ways, and one of such ways is for the outer shell (7) of the present system (1) to simply have the frontal portion (11) comprise an inner pocket (17) for selectively receiving therein a corresponding removable sternum foam pad (5*a*). This inner pocket (17) would be very similar to the one exemplified in FIGS. 13 and 14, and is preferably positioned in an inner portion of the outer shell (7) directly behind the outer sternum shield (15), as can be easily understood when referring to FIGS. 1-6, for example.

Similarly to what has been described in regards to the frontal portion (11) of the outer shell (7), said outer shell (7) also preferably comprises a rear portion (19) disposed along a substantially vertical axis, and defining a pair of rear opened areas (21) of the outer shell (7), each rear opened area (21) being provided on a corresponding side of the rear portion (19). These rear opened areas (21) of the outer shell (7) are preferably configured so as to be disposed about shoulder blade areas of the user, in order to allow a range of motion of the shoulder blade areas of the user within said rear opened areas (21) of the outer shell (7). Similarly to the aforementioned, the body parts of a given user of the present system lying behind the rear opened areas (21) of the outer shell (7) are preferably protected by corresponding pads provided on the undershirt (3), such as integrated shoulder blade pads (5*j*), as better shown in FIG. 4, for example.

As also shown in this figure, the rear portion (19) of the outer shell (7) is preferably substantially X-shaped, but it is worth mentioning also, that the rear portion (19) of the outer shell (7) may take on various other shapes and forms, depending on the particular application for which the present protective system (1) is intended for, and the desired end results, as can be easily understood by a person skilled in the art. One way or another, the rear portion (19) of the outer shell (7) preferably comprises an outer spine shield (23), or some sort of back/spine protection, as can also be easily understood when referring to the accompanying drawings, and the different embodiments shown therein.

Figure 14:
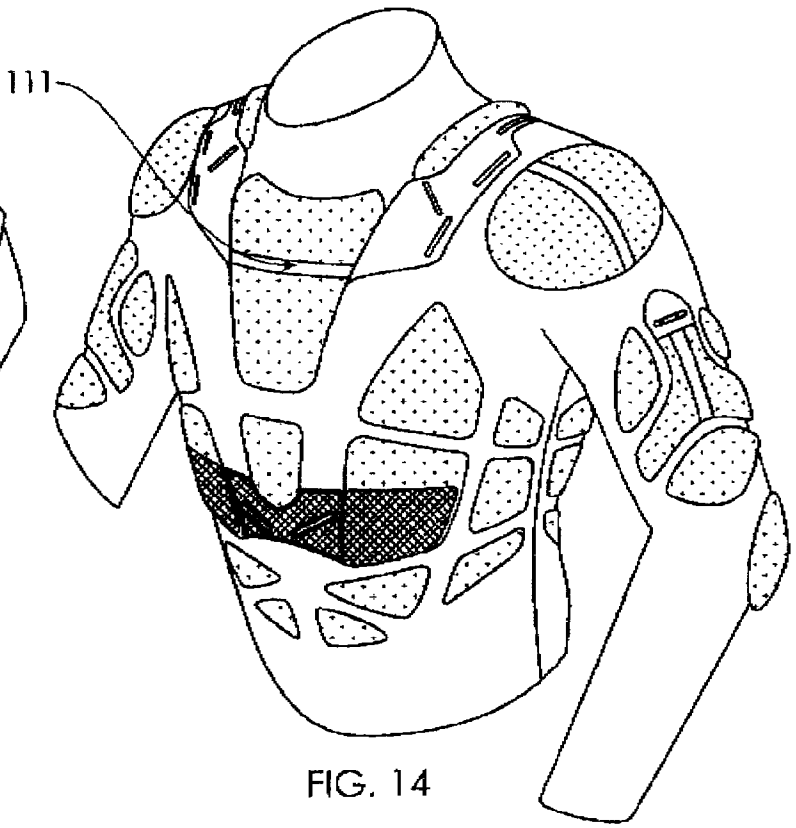
Figure 13:
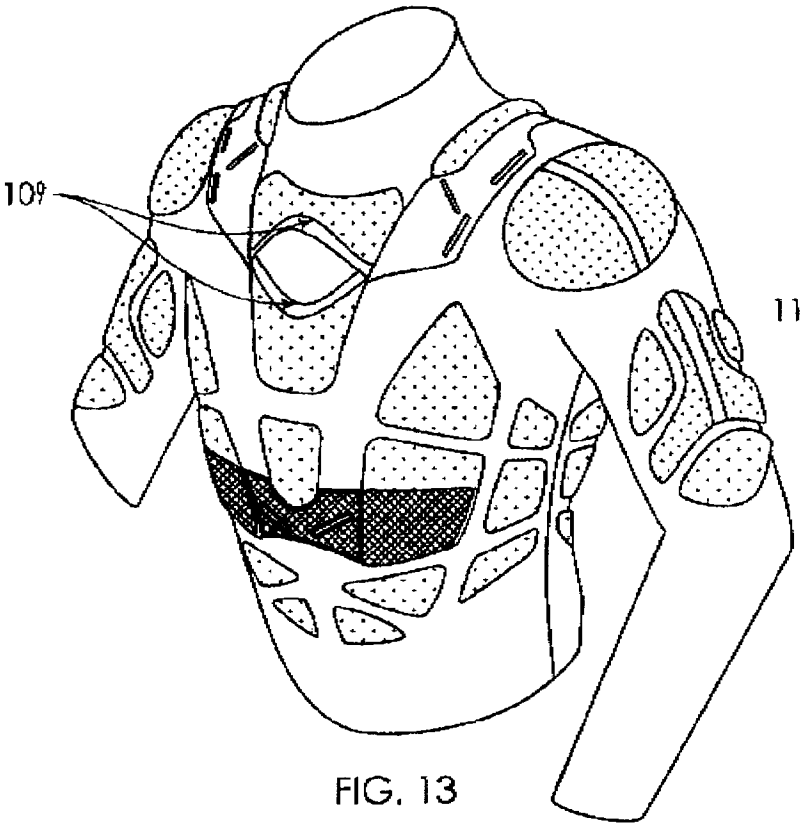

Similarly to what was described in reference to the frontal portion (11) of the outer shell (7), the rear portion (19) of the outer shell (7) comprises an inner pocket (25) for selectively receiving therein a corresponding removable spine foam pad (5*b*), this inner pocket (25) being very similar to the one exemplified in FIGS. 13 and 14, for example. Furthermore, the inner pocket (25) of the rear portion (19) of the outer shell (7) preferably lies in an inner portion of the outer shell (7), directly behind the corresponding spine shield (23) provided on the outer portion of the rear portion (19) of the outer shell (7), as can also be easily understood when referring to corresponding FIGS. 1-6.

As can also be easily understood by a person skilled in the art when referring to the accompanying drawings, the present protective system (1) is designed so that the outer shell (7) may comprise a pair of caps (27) selected from the group consisting of clavicle caps (27*a*), shoulder caps (27*b*), bicep caps (27*c*), shoulder blade caps (27*d*), and/or any other suitable cap (27). According to the embodiment illustrated in FIGS. 1-6, preferably at least one cap (27) of the outer shell (7) comprises a fastening assembly (29) for fastening a corresponding cap (27) about a corresponding arm portion of the user, and most preferably, said corresponding cap (27) is preferably a bicep cap (27*c*) which is preferably provided with a corresponding strap and fastening assembly (29), such as Velcro™ for example, so as to enable a given user of the protective system to secure the bicep cap (27*a*) against its corresponding bicep. Other suitable types of fastening assemblies (29) may be used, such as clips, straps, and the like, as apparent to a person skilled in the art.

As previously explained, the present protective system (1) is intended so as to not only be complementary and adjustable, but also customizable depending on the particular preferences of a given user, depending also on the type of protection being sought, depending on the particular range of motion or "freedom of movement" required, depending on the particular type of sport to be played, depending the particular type of position to be played by the user within said sport, and/or depending on various other types of considerations.

In order to enable such customization, and according to a first preferred embodiment of the present invention, as can be easily understood by a person skilled in the art in view of the present description and the accompanying drawings, at least one pad (5) of the undershirt (3) is selectively removable therefrom so as to vary a degree of protection of the protective system (1). Similarly, and as also shown, at least one pad (9) of the cuter shell (7) is selectively removable therefrom so as to vary a degree of protection of the protective system (1). Therefore, it may be appreciated that by selectively adding and/or removing corresponding pads (5,9) either on the undershirt (3) and/or on the outer shell (7), a user may vary a degree of protection offered by the overall protective system (1), and/or may also vary a degree of range of motion for certain body parts of the user, depending on the corresponding pads (5,9) having been added and/or removed accordingly.

An advantageous and efficient way of allowing corresponding pads to be easily added and/or removed from the present protective system (1) is to have the undershirt (3) preferably comprises at least one pocket (31) for receiving a corresponding removable pad therein (5), and to have the outer shell (7) preferably comprises at least one pocket (33) for receiving a corresponding removable pad (5) therein. Preferably, and as will be explained in greater detail hereinbelow, such corresponding removable pads (5,9) are strategically placed about the undershirt (3) and the outer shell (7) so as to have an overall protective system (1) that is complementary and adjustable.

An interesting aspect of the present invention also lies in the fact that the protective system (1) is intended to have at least one component which is configured to be interchangeable between the undershirt (3) and the outer shell (7). Such a component may consist of a removable connecting link (43) which will therefore allow the present protective system (1) to be used under different operating modes, whether "complementary" if it is disposed about the outer shell (7), or in an "integrated" made if it is mounted about the undershirt (3), as will be explained in greater detail hereinbelow, but according to another aspect of the present invention, customization, and the complementary nature of the overall system (1), also lies in that, according to a preferred embodiment of the present invention, at least one pad (5) of the undershirt (3) is configured to be interchangeable with at least one pad (5,9) of the outer shell (7), and vice-versa.

Indeed, as can be easily understood when referring to FIGS. 1-6 for example, first and second pockets (31,33) provided respectively on the undershirt (3) and the outer shell (7) have substantially the same shape and substantially the same size so that a corresponding pad (5) configured for removably inserting into the first pocket (31) of the undershirt (3) may be removably insertable into the second pocket (33) of the outer shell (7), and vice-versa. Such a corresponding pad (5) may be removable sternum foam pad (5*a*), for example, and/or may be a removable spine foam pad (5*b*). Preferably also, and as can be easily understood when referring to FIGS. 1-6, for example, according to another preferred embodiment of the present invention, at least one pad (5) of a same given component of the protective system (1) may be configured to be interchangeable between at least two corresponding pockets (31,33) of a same given component. For example, when contrasting FIGS. 3 and 4 for example, it can be easily understood that the pocket (31) indented for the removable sternum foam pad (5*a*), and the pocket (31) intended for the removable spine foam pad (5*b*), may also have substantially the same shape and essentially the same size so that at least one of such pads (5*a*,5*b*) may be used from one pocket (31) to the next, in addition to being able to be insertable into a corresponding inner pocket (33) of the frontal portion (11) of the outer shelf (7) and/or into a corresponding inner pocket (33) of the rear portion (19) of the outer shell (7), which are also preferably intended to have substantially the same shape and substantially the same size, as can be easily understood when referring to FIGS. 5 and 6, for example. Therefore, according to a preferred embodiment of the present invention, both the inner pocket (33) of the frontal portion (11) of the outer shell (7) and the inner pocket (33) of the rear portion (19) of the outer shell (7), as well as the receiving packet (31) for the removable sternum foam pad (5*a*) on the front portion of the undershirt (3), and the corresponding pocket (31) for receiving the removable spine foam pad (5*b*) on the rear portion (19) of the undershirt (3), are preferably configured to have substantially the same shape and substantially the same size so that not only a same given component (5) can be interchangeable between either one of these pockets (31,33), but also, so that several removable pads (5) to be used with the present protective system (1) be substantially similar or identical, which is also advantageous for ease and convenience, whether from a manufacturing point of view, or even more advantageously, from a player's perspective when using the present protective system (it is nice to have several pieces that are essentially the same, for sake of simplicity, etc.).

Another important advantage resulting from the present protective system (1) results in that due to the fact that it is adjustable and complementary, and by virtue of its particular design, it enables the outer shell (7) to be securely maintained in position with respect to the body of a given user due to the fact that, contrary to conventional systems which rely on frictional engagement between an undershirt and an outer shoulder pad for ensuring maintainment, the present protective system (1) provides a more complete and secure positioning, by virtue of a "mechanical interlocking" of components, that is, a positive engagement between outer shell (7) and undershirt (3), instead of simply relying on a superficial frictional engagement.

Figure 7:
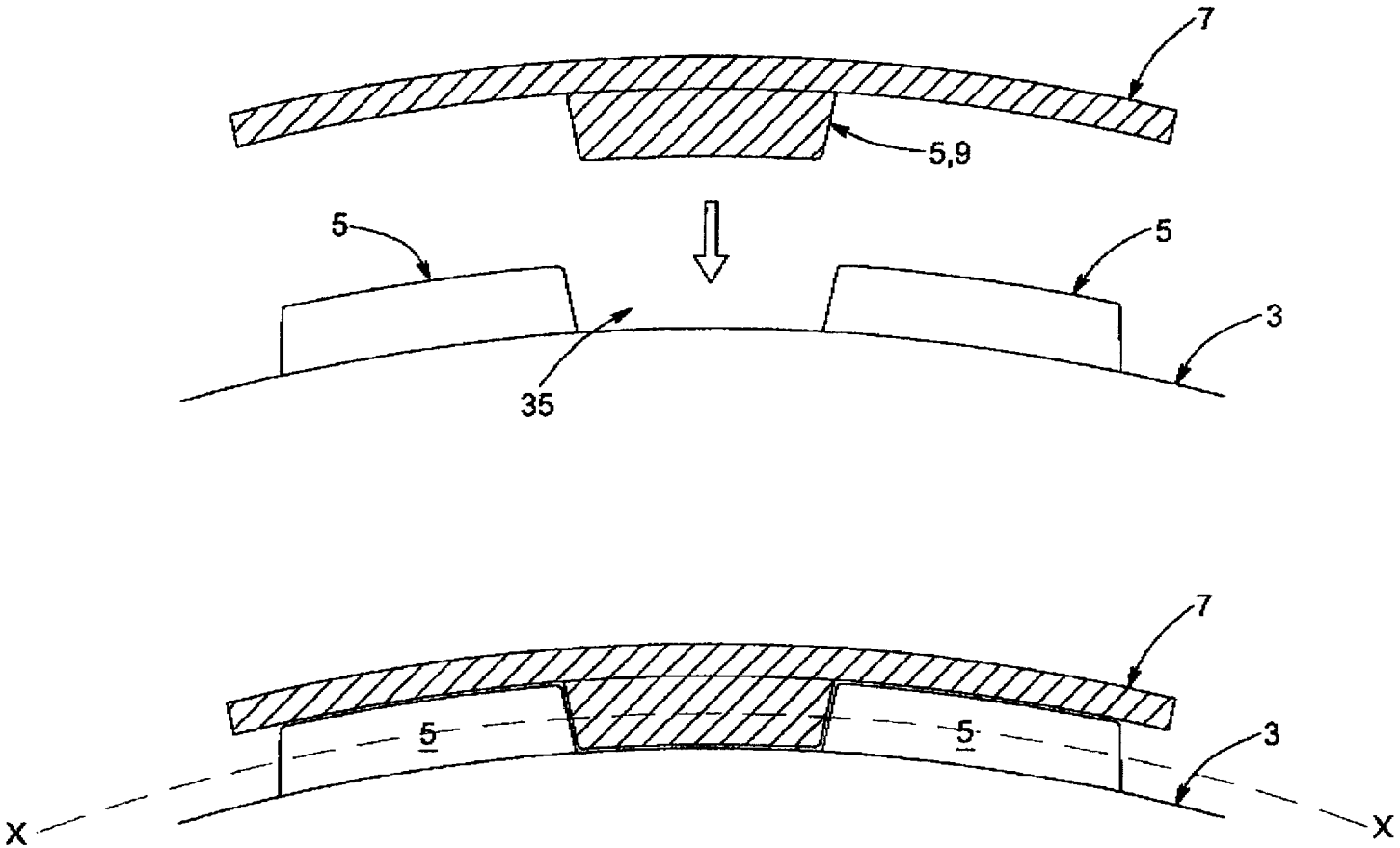
FIG. 7 is a schematic representation of a mechanical interlocking between an undershirt and an outer shell of the protective system according to a preferred embodiment of the present invention, illustrating both before and after the mechanical interlocking.
Figure 8:
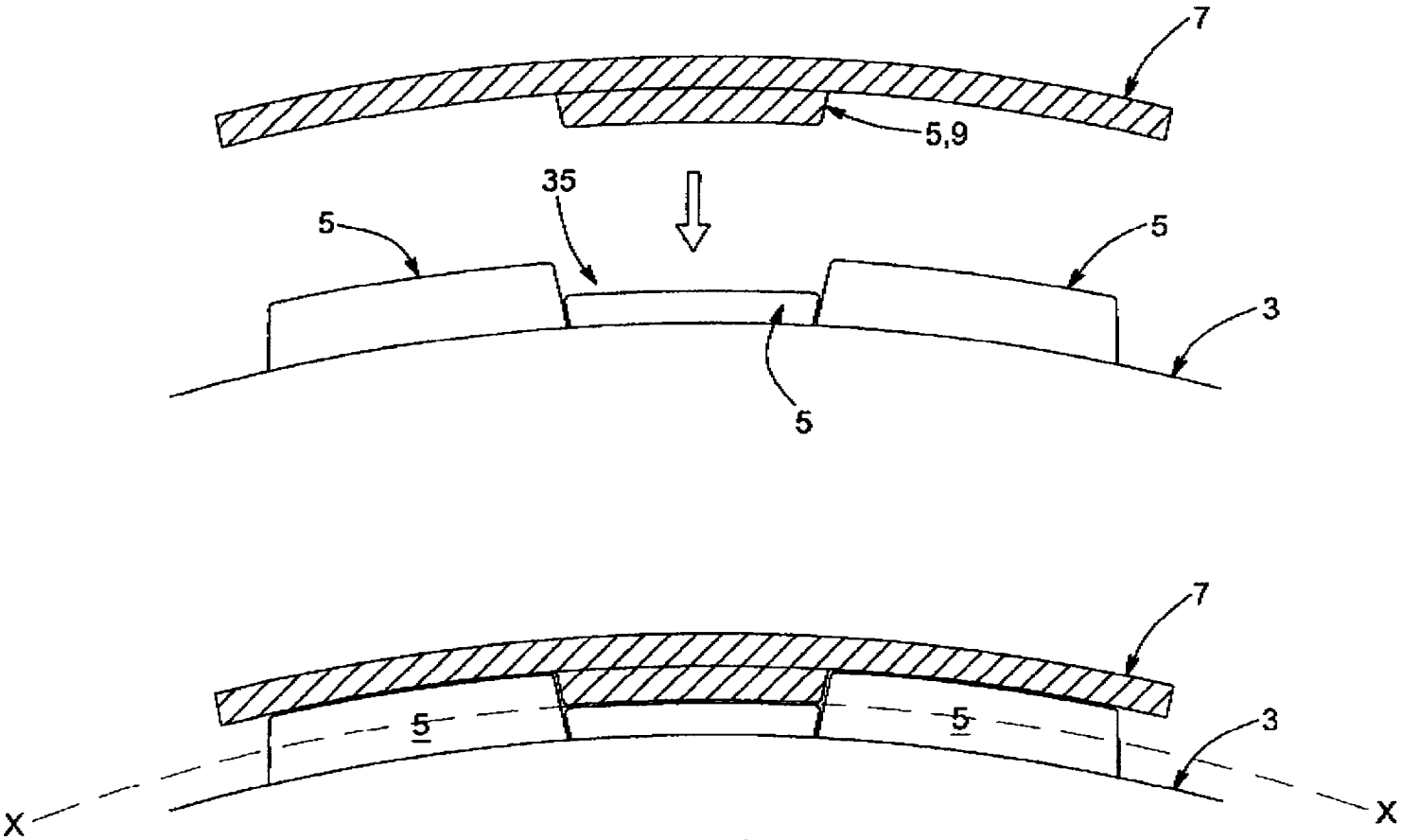
FIG. 8 is a schematic representation of a mechanical interlocking between an undershirt and an outer shell of the protective system according to another preferred embodiment of the present invention, illustrating both before and after the mechanical interlocking.

In order to accomplish such a mechanical interlocking, and according to a preferred embodiment of the present invention, as shown schematically in FIG. 7 for example, the undershirt (3) comprises a pair of pads (5) defining a space (35) between said pads (5), the space (35) being configured so that a corresponding pad (5,9) of the outer shell (7) be insertable into the space (35) when the outer shell (7) is mounted onto the undershirt (3), for providing a mechanical lock between the undershirt (3) and the outer shell (7), thereby preventing a transversal or lateral displacement between the outer shell and the undershirt (3) along axis X-X, for example, as can be easily understood when referring to FIGS. 7 and 8. It is worth mentioning also, as can be easily understood by a person skilled in the art, that the corresponding pad (5,9) or component of the outer shell (7) being insertable into the space (35) defined between a pair of corresponding pads (5) or components of the undershirt (3) need not to be a "press-fit" or a "force-fit", in that, even with an appropriate slack between such components, the present system (1) would prevent a transversal or lateral movement between the outer shell (7) and the undershirt (3) along axis X-X so as to advantageously maintain the outer shell (7) in proper positioning with respect to the body of the user, thanks to such a positive mechanical interlocking of the two complementary components of the protective system (1).

According to a preferred embodiment of the present invention, the space (35) intended for providing such mechanical interlocking is the one defined between a pair of corresponding integrated chest pads (5*g*), on a front portion of the undershirt (3), said space (35) being also configured for receiving a corresponding removable sternum foam pad (5*a*) of the outer shell (7). It is also worth mentioning that, even if such space (35) is provided with such a corresponding sternum foam pad (5*a*), a mechanical interlocking could still be provided by the present protective system (1), as exemplified in FIG. 8 for example. Furthermore, in addition to having a positive interlocking between the outer shell (7) and the undershirt (3) on a front portion of the protective system (1), a similar interlocking can also be provided on a rear portion of the protective system (1), by defining a corresponding space (35) between a pair of integrated shoulder blade pads (5*j*), for example, as can be easily understood by a person skilled in the art when referring to FIGS. 1-4 for example. Thus, it may be appreciated that the mechanical interlocking between the undershirt (3) and the outer shell (7) may take on various other different shapes, forms and configurations according to the present invention, depending on the particular applications for which the present system is intended for, and the desired end results, as can be easily understood by a person skilled in the art.

Similarly, it is worth mentioning that the space (35) need not be defined on the undershirt (3), but alternatively, may be defined on the outer shell (7), in which case the outer shell (7) could simply comprise a pair of pads (5,9) or other components defining a space (35) between said pads (5,9) or components, said space (35) being configured so that a corresponding pad (5) or other component of the undershirt (3) be insertable into the space (35) when the outer shell (7) is mounted onto the undershirt (3), for providing a mechanical lock between the undershirt (3) and the outer shell (7).

According to a preferred embodiment of the present invention, the undershirt (3) comprises both removable pads (5') and integrated pads (5"). Preferably, and as can be easily understood when referring to FIGS. 3 and 4 for example, each removable pad (5') of the undershirt may be selected from the group consisting of a removable sternum pad (5*a*), a removable top spine pad (5*b*), a removable shoulder pad (5*c*), a removable bicep pad (5*d*), a removable front rib pad (5*e*), a removable back rib pad (5*f*) and/or any other removable suitable (5). Similarly, each integrated pad (5") of the undershirt (3) may be selected from the group consisting of an integrated molded shoulder pad (5*c*), an integrated molded bicep pad (5*d*), an integrated front rib pad (5*e*), an integrated back rib pad (5*f*), an integrated chest pad (5*g*), an integrated abdominal pad (5*h*), an integrated lower back pad (5*i*), an integrated shoulder blade pad (5*j*) and/or any other suitable integrated pad (5).

It is worth mentioning that the present protective system could be modified so that some of the removable pads (5') be actually integrated pads (5"), and vice versa, once again, depending on the particular applications for which the present protective system (1) is intended for, and the desired end results, as can be easily understood by a person skilled in the art. Furthermore, the pads (5) of the protective system (1) to be integrated into the undershirt (3) are done so via a suitable process, such as stitching, bonding, molding, thermo-welding and/or any other suitable process.

According to another preferred embodiment of the present invention, the undershirt (3) comprises at least one flex zone (37), and each flex zone (37) may be selected from the group consisting of a clavicle flex zone (37*a*), a shoulder flex zone (37*b*), a bicep flex zone (37*c*), a pectoral flex zone (37*d*), a scapular flex zone (37*e*), a shoulder blade flex zone (37*f*), a tricep flex zone (37*g*) and/or any other suitable flex zone (37). Preferably also, each flex zone (37) is provided by a corresponding zone (37) of the undershirt (3) made of a corresponding meshed material.

Advantages of providing such flex zones (37) within the undershirt (3) are that not only do they enable a greater and easier range of motion for key body parts of the user which need certain flexibility and moveability, but also provide a convenient and efficient way of dissipating heat and sweat of the user in areas that are prone to accumulation of sweat or heat, thereby providing for a much more comfortable garment then what is possible with those of the prior art which typically have an undershirt which is made of a unitary and solid material throughout the entire undershirt.

According to another preferred aspect of the present invention, the impact-dispersion pads (9) of the outer shell (7) comprise at least one substantially rigid plate (39) configured to cover each flex zone (37) of the undershirt (3) when the outer she (7) is worn over said undershirt (3). Each pair of substantially rigid plates (39) of the outer shell (7) are preferably interconnected by means of a substantially flexible stretch connection (41). Preferably also, the outer shell (7) comprises at least one stretch connection (41) selected from the group consisting of a clavicle-to-shoulder blade stretch connection (41*a*), a clavicle-to-sternum stretch connection (41*b*), a shoulder blade-to-spine stretch connection (41*b*) and/or any other suitable stretch connection (41). This interaction between the outer shell (7) and undershirt (13), particularly the fact that the impact-dispersion pads (9) are intended to cover each flex zone (37) of the undershirt (3) further illustrates the complementary nature of the present system (1), in that, the flex zones (37) of the undershirt (3) enable corresponding body parts of the user to cover a wide range of motion, and in that the overlying impact-dispersion pads (9) of the outer shirt (7) are meant to protect such flex zones (37).

As better exemplified in FIGS. 1, 2, 5 and 6, and according to a preferred embodiment of the present invention, the protective system (1) comprises a pair of straps (45) for fastening the outer shell (7) onto the user, each strap (45) originating from a corresponding side of a rear portion (19) of the outer shell (7) and having an extremity (47) being selectively securable onto a corresponding wing section (43*b*) of the connecting link (43) on the frontal portion (11)

of the outer shell (7) by means of a suitable fastening assembly (29), similar to what is possible with conventional shoulder pads.

However, another important aspect of the present invention resides in that the protective system (1) comprises a connecting link (43) for enabling to operatively fasten the outer shell (7) onto the user, that is, for enabling to operate the present protective system (1) in an "integrated" mode.

Indeed, according to a preferred embodiment of the present invention, and as better exemplified in FIGS. 1-6 and 36-40, the connecting link (43) comprises a pair of wing sections (43) each projecting out from a corresponding side (11*b*) of a bottom part (11*a*) of a frontal portion (11) of the outer shell (7), in a direction substantially traverse to that of the frontal portion (11).

Furthermore, the connecting link (43) may be removably mountable onto the bottom part (11*a*) of the frontal portion (11) via a flap-tab assembly (49), as better shown in FIGS. 41-46.

Figure 46:
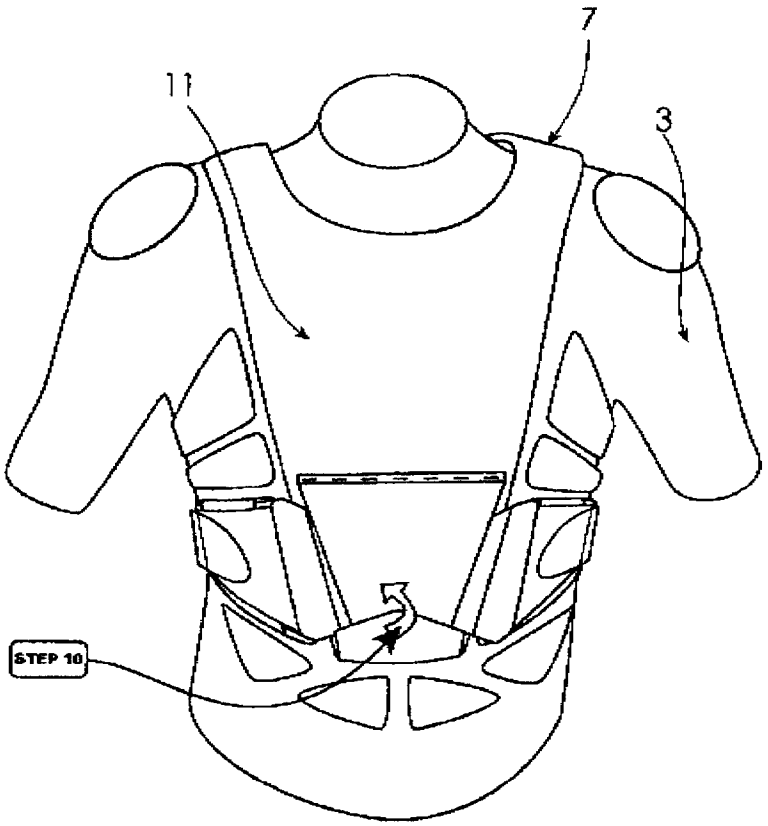
Figure 45:
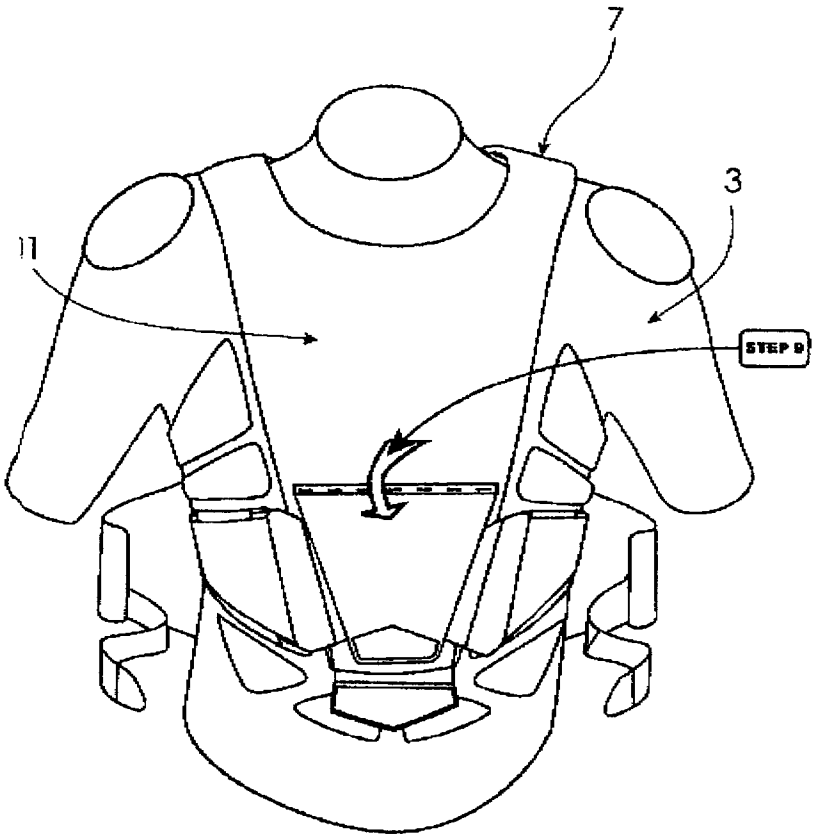

According to a preferred embodiment of the present invention, and as better shown in these figures, the flap-tab assembly (49) comprises a flap (51) projecting from the frontal portion (11) of the outer shell (7) and being hingedly connectable thereto, a tab (53) provided on a distal end of the flap (53) and being hingedly connected thereto, and a securing assembly (55) for removably securing the tab (53) onto an extremity (11*c*) of the frontal portion (11) of the outer shell (7), so as to selectively define a corresponding securing loop (57), the connecting link (43) of the protective system (1) being selectively mountable within said securing loop (57), as can be easily understood when referring to FIG. 46 for example.

Indeed, according to a preferred embodiment of the present invention, wing sections (43*b*) of the connecting link (43) are removably insertable into a pair of corresponding sleeves (61) provided on a frontal portion (11) of the undershirt (3), for selectively interconnecting the outer shell (7) to the undershirt (3) via the connecting link (43).

Preferably, the connecting link (43) comprise a central section (43*a*), a pair of wing sections (43*b*) and a pair of looping sections (43*c*). Each wing section (43*b*) preferably projects out from a corresponding side of the central section (43*a*), and each looping section (43*c*) preferably projects out from a corresponding side of a given wing section (43*b*), and is meant to be foldable about a given sleeve (61) when said given wing section (43*a*) is inserted therein so as to be removably secured back onto a connecting portion (43*d*) of the central section (43*a*) via a corresponding securing assembly (43*e*), as better shown in FIGS. 41-46.

Figure 36:
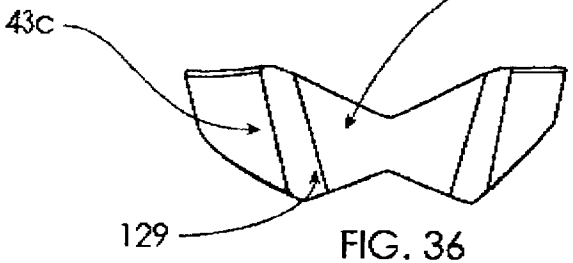
Figure 37:
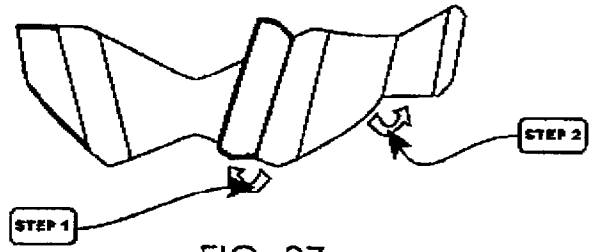

Preferably, the central portion (43*a*) of the connecting link (43) comprises upper and lower recessed segments (43*f*, 43*g*), as better shown in FIG. 36. These recessed segments (43*f*,43*g*) are preferably shaped and sized so as to ensure a more efficient cooperation with a corresponding bottom part (11*a*) of the frontal portion (11) of the outer shell (7).

Thus, it may now be better appreciated that the connecting link (43) according to a preferred embodiment of the present invention is not only preferably interchangeable between the bottom part (11*a*) of the frontal portion (11) of the outer shell (7), so as to provide corresponding attachment means for corresponding straps (45) of the outer shell (7) according to one operating mode, that is, a "complementary" mode, as shown in FIGS. 1 and 5 for example, but may also be removably mountable onto corresponding pairs of sleeves (61) on the undershirt (3) so as to selectively allow a user to secure the front portion (11) of the outer shell (7) about a central point of the undershirt (3), so as to operatively integrate the outer shell (7) onto the user along another operating mode, that is, an "integrated" mode, for improved securement about the user, as better shown in FIGS. 43-46.

Thus, in order to allow the present protective system (1) to be operated along an "integrated" mode, the undershirt (3) preferably comprises at least one anchor (59) for selectively interconnecting the outer shell (3) to the undershirt (3). Said at least one anchor (59) may take on various shapes and forms, such as loops, hooks, and the like, but according to a preferred embodiment of the present invention, said at least anchor (59) preferably takes on the form of at least one sleeve (61) provided on the undershirt (3). Said at least one sleeve (61) preferably comprises a pair of sleeves (61), each sleeve (61) being provided on either side of a central portion (63) of the undershirt (3), as exemplified in FIGS. 3 and 46, for example.

Figure 48B:
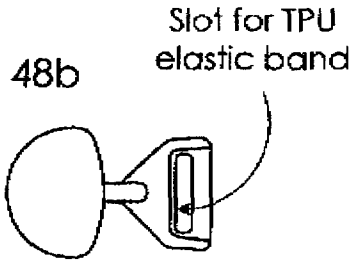
Figure 48A:
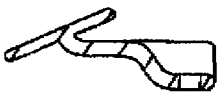

Preferably, each sleeve (61) is configured for receiving a corresponding wing section (43*b*) of a connecting link (43) of the protective system (1), as better shown in FIG. 48.

Preferably also, each sleeve (61) is made of a stretchable material. By having an anchoring point, such as a sleeve (61) opened at both ends thereof, made of a stretchable material, this allows the undershirt (3) to be easily insertable by a corresponding user, while also being comfortable.

According to a preferred embodiment of the present invention, the connecting (ink (43) is an abdominal link (43), and such abdominal link (43) is preferably designed so as to be selectively removable from the outer shell (7), and to be removably mountable onto a pair of sleeves (61) of the undershirt (3), so as to serve as an anchoring link (43) for selectively interconnecting a frontal portion (11) of the outer shell (7) onto the undershirt (3) via the corresponding flap-tab assembly (49).

Preferably, portions of the undershirt (3) are provided with printed grip zones (65) for gripping corresponding portions of the outer shell (7) when placed over the undershirt (3), so as to provide an additional frictional engagement between the outer shell (7) and the undershirt (3), as can be easily understood when referring to FIGS. 1-6, for example.

According to another preferred embodiment of the present invention, the protective system (1) may comprise one or several base liners (67) being removably mountable onto the outer shell (7). Indeed, the protective system (1) may comprise front and back base liners (67) for providing additional protection to abdominal and/or rib portions of the user, in certain cases, if required, as exemplified in FIG. 54-57. The base liner (67), such a front base liner (67) for example, may be removably mountable onto the outer shell (7) by means of the connecting link (63), in which case, the base liner (67) may simply comprise a pair of loops through which the first and second wing sections (43*b*) of the connecting link (43) may be removable insertable. Similarly, the rear base liner (67) may be provided with corresponding sleeves (61) through which first and second straps (45) of the outer shell (7) may be removably insertable. Other portions of each base liner (67) may also be removably connectable to the outer shell (7) by means of corresponding attachment assemblies, such as other loops, clips, Velcro™ components, and the like.

As previously explained, both the outer shell (or "outer pad") and the protective undershirt base layer are composed of removable protective parts that will allow the user to customise the level of protection offered by the system, as shown in the accompanying drawings. There are various ways in which this can be achieved according to the present invention. For example, FIGS. 35-44 show how the protective undershirt (3), the abdominal link (43) and the modular shoulder pad join together to form the integrated system (1). FIGS. 47-53 show a new flexible plastic (ex. TPU, etc.) connector made to join the shoulder cap to the frame of the modular shoulder pad or to the protective undershirt.

As will be explained in greater detail hereinbelow, the system is preferably of simple design and inexpensive to manufacture. As will also be shown hereinbelow, the protective system (1), corresponding components thereof and resulting equipment, present several advantages when compared to protective systems known in the art.

Indeed, regarding the protective undershirt base layer, as exemplified in FIGS. 9-14, it is preferably made of form-fitting stretchable, breathable and sweat wicking performance material combined with strategically positioned impact dispersion and absorption perforated pads (5) or "inserts". Some inserts are permanently attached to the protective undershirt base layer and cannot be removed. Others such as the thorax, spine, shoulder, bicep and elbow caps can be removed. Additional protective parts originating from the modular shoulder pad can also be attached directly to the protective undershirt base layer in order to better customise the system for more or less player protection or more or less player body motion. Unlike actual shoulder pads, the protective undershirt base layer according to the present invention, as exemplified and described herein, offers non-obstructive close-to-the-body protection.

Figure 9:
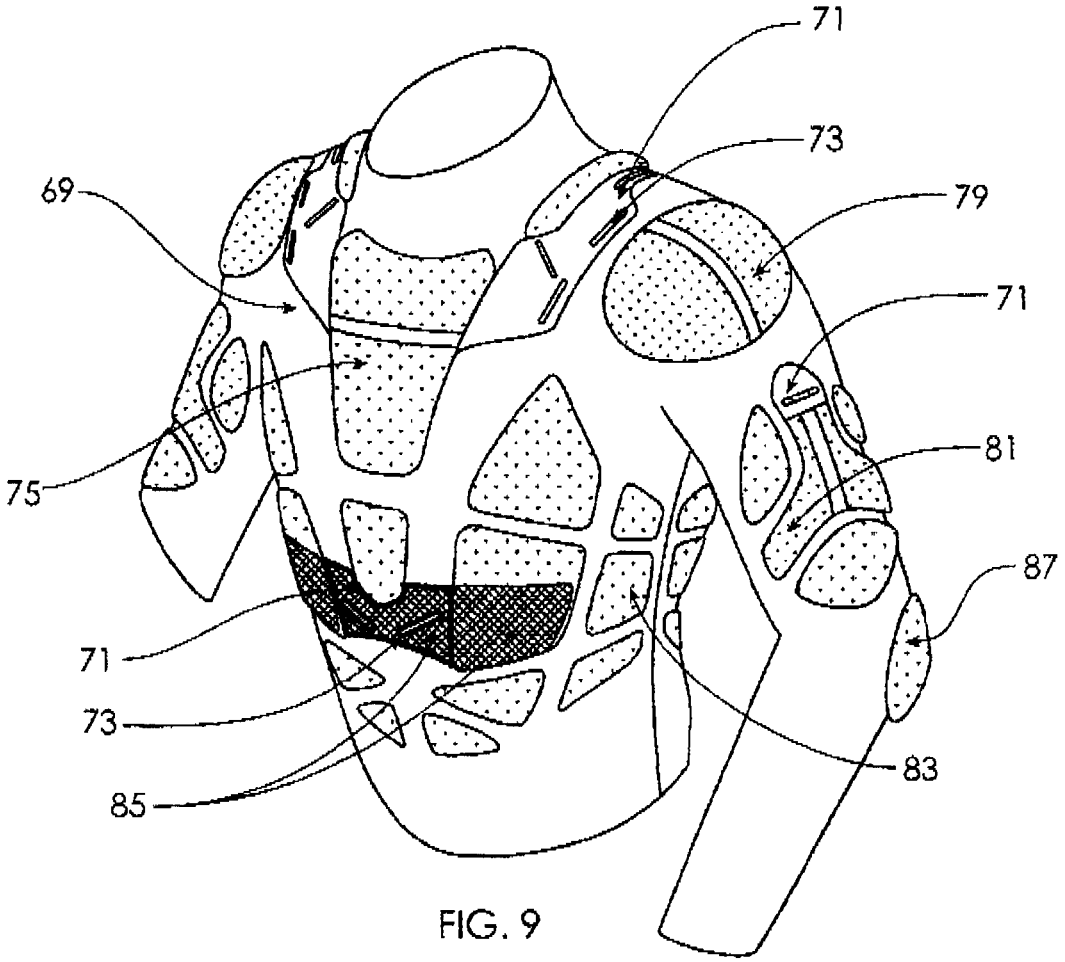
Figure 10:
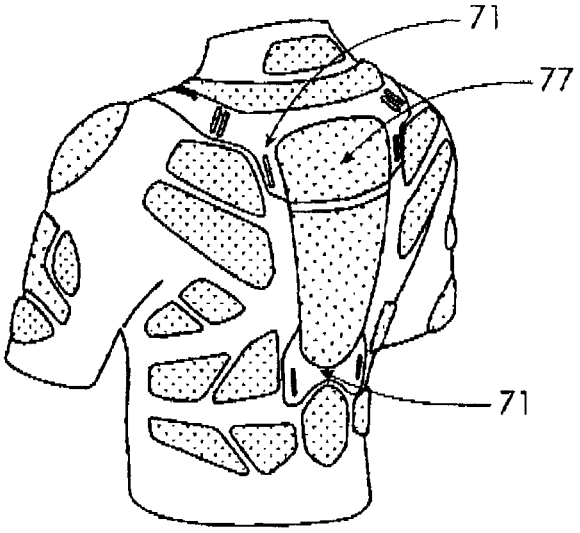

Concerning the protective undershirt base layer, FIG. 9 shows a front view according to a preferred embodiment of the present invention, whereas FIG. 10 shows a back view thereof according to a preferred embodiment of the present invention. As better shown in these figures, the undershirt comprises a series of preferred components and features, namely: a) a protective undershirt base layer (69) made with form-fitting stretchable, breathable and sweat wickening performance material and of strategically integrated impact dispersion and absorption inserts; b) a reinforced portion (71) for anchoring points; c) at least one anchoring point (73), such as slots or slits for example, for receiving protective components originating from the modular shoulder pad; d) a chest protector (75) preferably in the form of a removable two layer set of one perforated impact dispersion and one absorption insert; e) a spine protector (77) preferably in the form of a removable two layer set of one perforated impact dispersion and one absorption insert; f) a shoulder protector (79) preferably in the form of a removable two layer set of one perforated impact dispersion and one absorption insert; g) a bicep protector (81) preferably in the form of a removable two layer set of one perforated impact dispersion and one absorption insert; h) at least one other protector (83) preferably in the form of a non-removable perforated foam insert(s); i) an integrated attachment surface (85) for the modular shoulder pad; and j) an elbow protector (87) preferably in the form of a removable moulded plastic and absorption foam inserts.

The protective undershirt base layer offers sufficient protection for recreational use and adult non-physical contact leagues. It includes strategically protective features (chest and spine deflectors, shoulder and elbow caps) positioned close to the body (i.e. "skin tight") for improved player body motion. It also includes anchoring points in order to add extra protective components like the modular shoulder pad, as shown in the accompanying figures.

Figure 11:
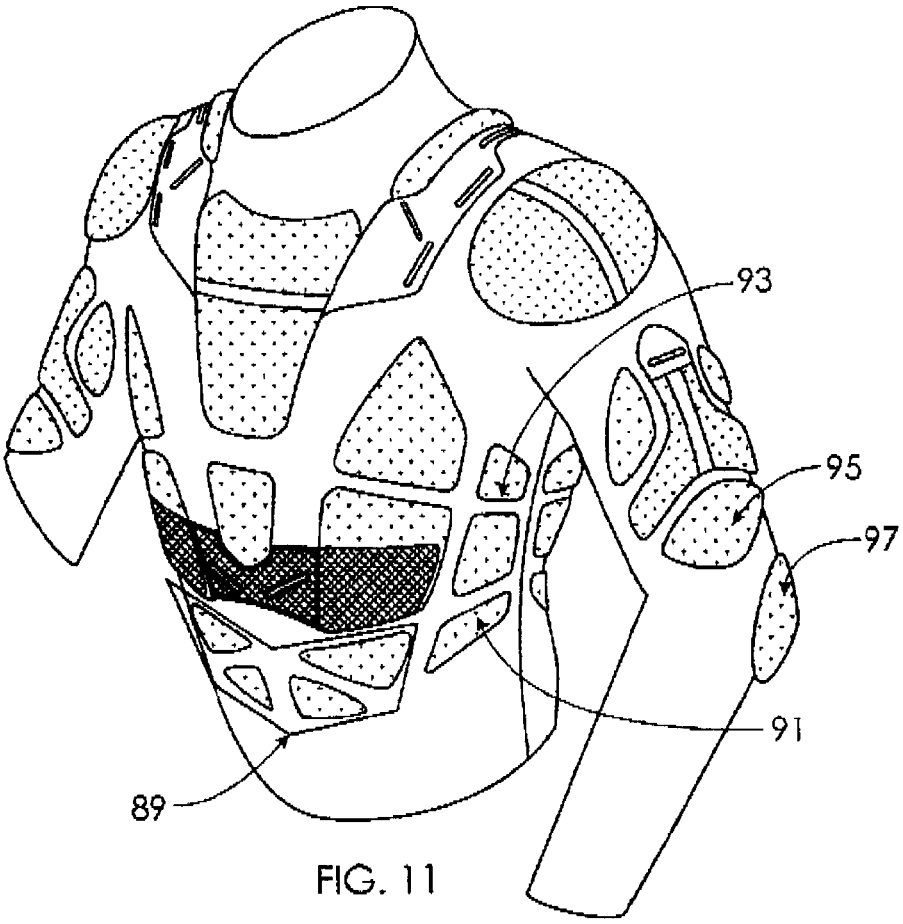
Figure 12:
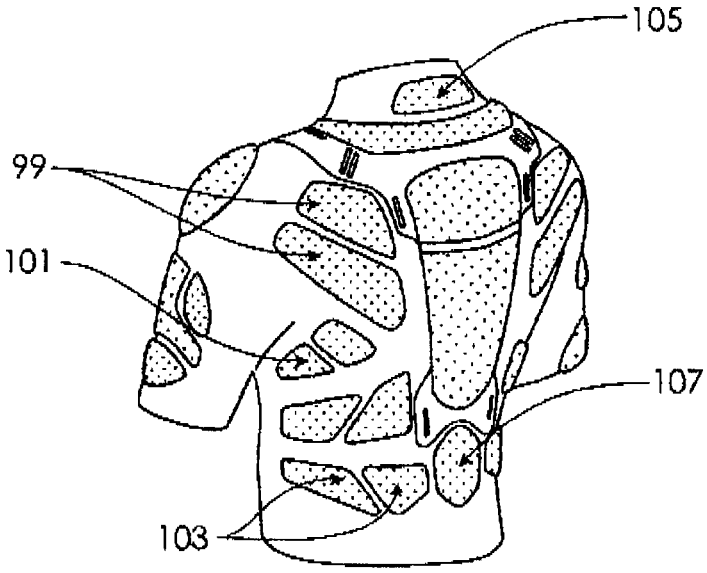

Regarding the extended protection relating to the protective undershirt base layer as exemplified in FIGS. 11 and 12 which show respectively front and rear views thereof according to a preferred embodiment of the present invention, it is worth mentioning that the illustration in these figures shows the protection that extends beyond the contour of actual shoulder pads. As exemplified in these figures, and as can be easily understood by a person skilled in the art, the extended protection according to the present invention comprises various components and features, namely: a) a lower abdominal section (89); b) a front lower rib section (91); c) a front underarm rib section (93); d) a lower bicep section (95); e) an elbow (97); f) a shoulder blade section (99); g) a back underarm rib section (101); h) a kidney section (103); i) an upper spine section (105); j) a lower spine section (107); k) a fabric (109) that stretches to create an opening in a pouch or pocket that contains removable insert or pad; and l) a fabric overlap (111) to create closure and for retaining the insert or pad in the pouch or pocket.

Regarding the removable inserts to be used with the protective undershirt base layer according to a preferred embodiment of the present invention, and as exemplified in FIGS. 13 and 14, they preferably comprise two major components with corresponding preferred features, namely: a) a fabric (109) that stretches to create opening in pouch that contains removable insert, this feature allowing for the extraction of the insert; and b) a fabric overlap (111) that overlaps to create closure and retains insert in pouch.

Figure 16:
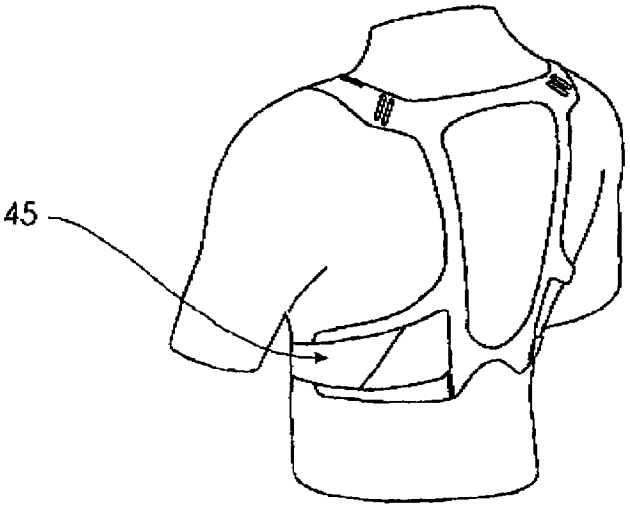
Figure 15:
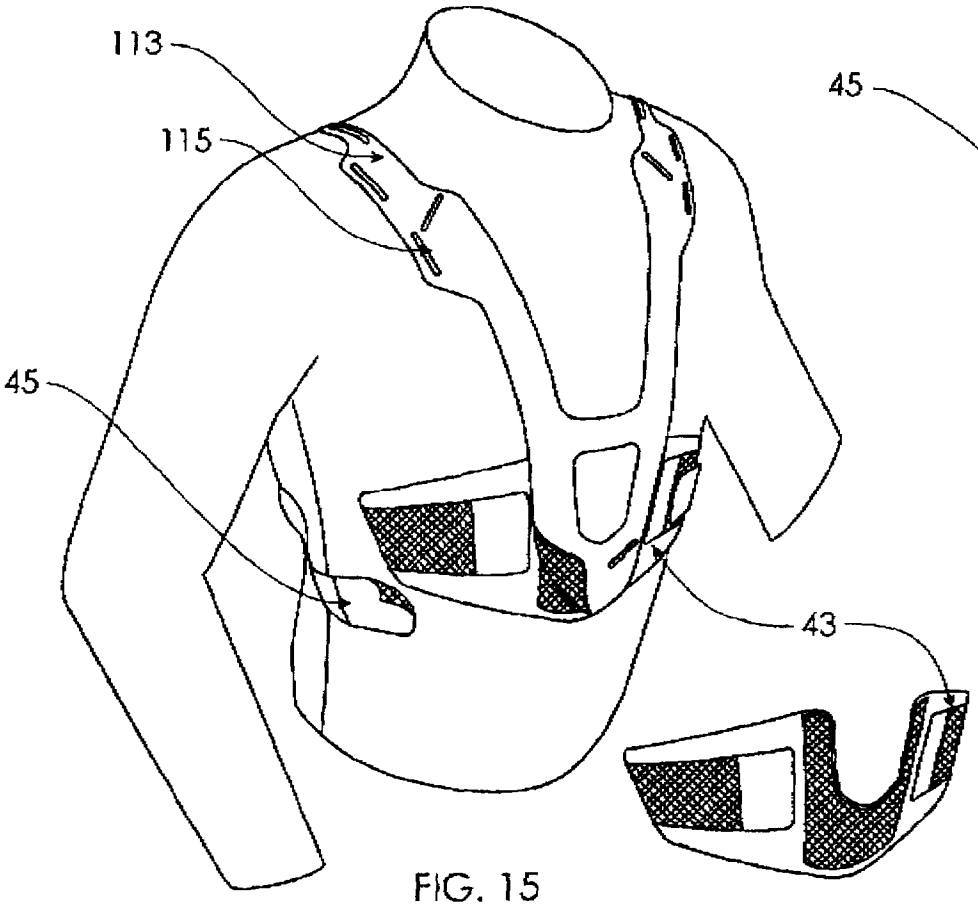
Figure 18:
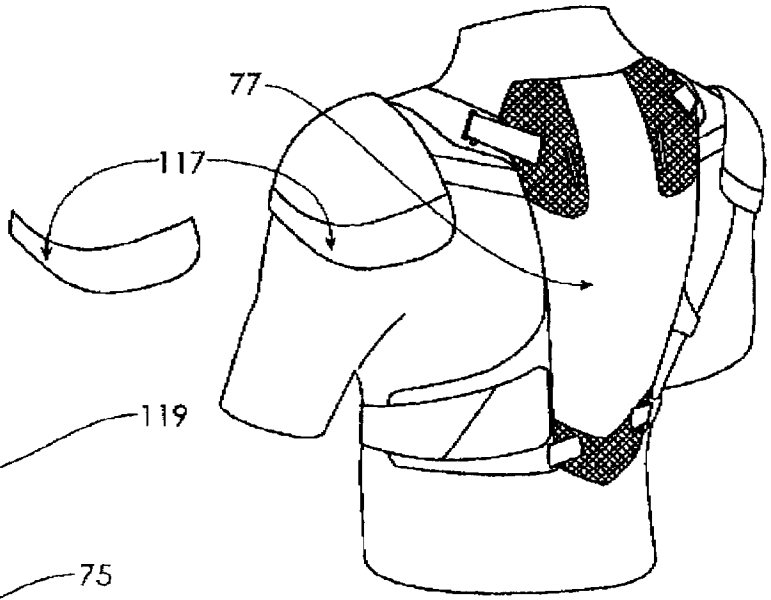
Figure 17:
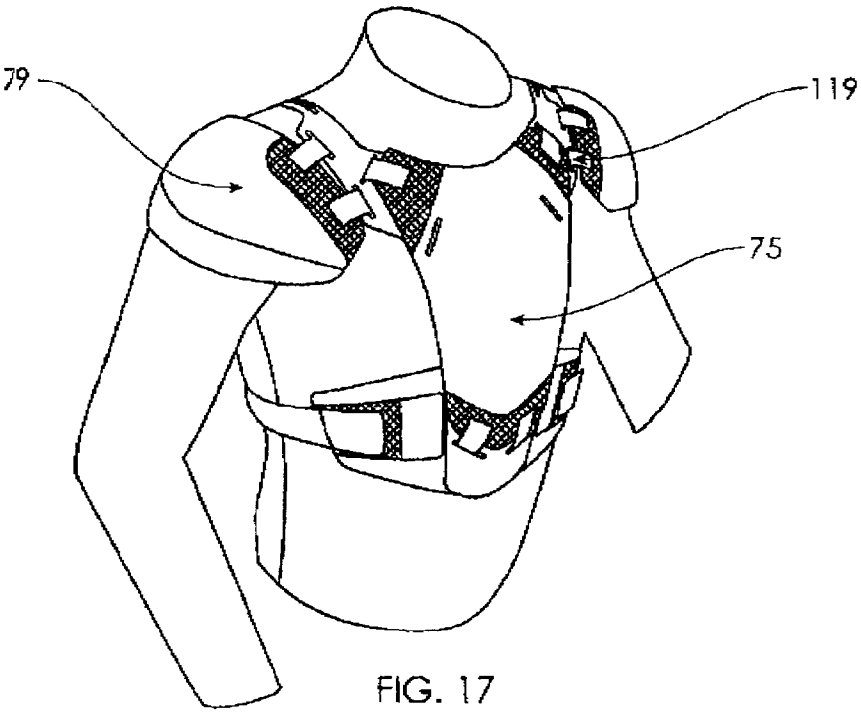

Referring now to the frame of the modular shoulder pad according to a preferred embodiment of the present invention, as exemplified in FIGS. 15 and 16, the modular shoulder pad is preferably composed of a frame (or "harness") that rests on the shoulders and wraps around the waist. Free floating and removable protective parts are connected to the frame with elastic and non-elastic connectors. These protective parts can also be attached directly to the protective undershirt base layer using the same connectors as in the modular shoulder pad.

As better exemplified in FIGS. 15 and 16, which show respectively front and rear views of a harness according to a preferred embodiment of the present invention, a modular shoulder pad system according to the present invention preferably is composed of a frame ("harness") with anchoring points on which the protective components such as spine protector, thorax protector and shoulder caps are attached to. Preferably also, the attachment system will be made of stretch and non-stretch material such as nylon webbings and Velcro™ hook-and-loop or other moulded materials such as TPU.

Regarding the frame description of the modular shoulder pad according to a preferred embodiment of the present invention, and as exemplified in FIGS. 15 and 16, it preferably has different preferred components and features, namely: a) an upper body frame (113); b) integrated anchoring points (115) for protective components (illustrated with slots); c) a removable abdominal link (43); and d) an integrated elastic strap (45) that wraps around the waist to join the back of the harness to the front of the harness or protective undershirt base layer.

Regarding the removable protective components to be used with the modular shoulder pad according to a preferred embodiment of the present invention, and as better shown in FIGS. 9-10, they preferably comprise various preferred components and features, namely: a) a removable chest protector (75); b) a removable spine protector (77); c) a removable shoulder protector (79); d) a shoulder protector with removable section for more free body motion; and e) an elastic connector (119) between removable components and harness—variable elasticity (O+) or length (as required for body motion)—typical to all removable components—also used to attach removable components to undershirt (3).

It is worth mentioning that the protection offered by the modular shoulder pad is customisable. The player can choose to keep or remove the protective components in order to customise his (or her) shoulder pads for more protection and/or for more agility.

Figure 20:
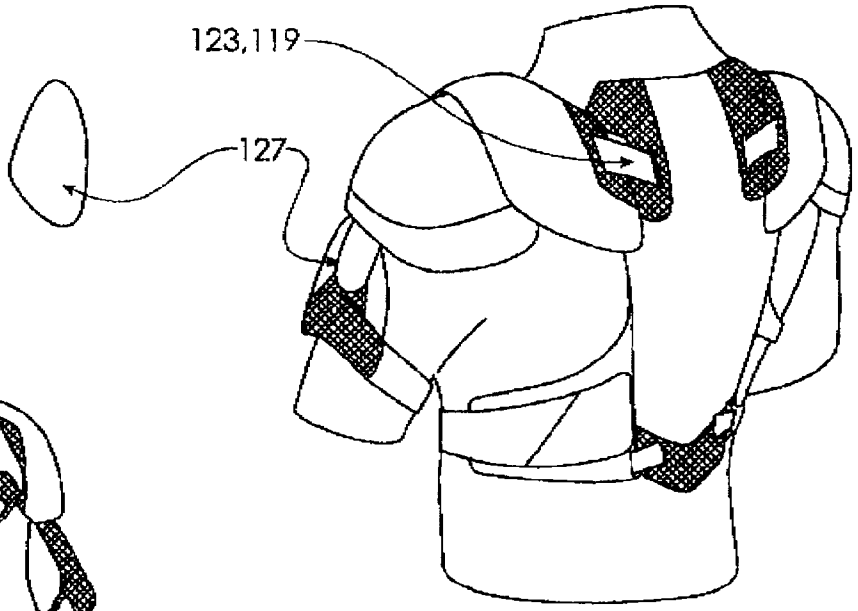
Figure 19:
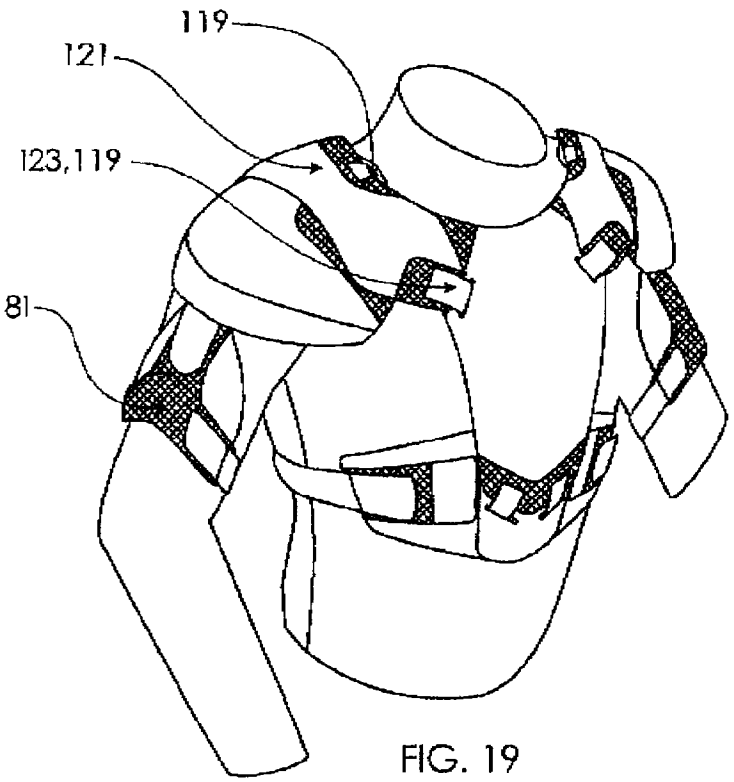

As may now be better appreciated by a person skilled in the art, referring now to the removable protective components for the modular shoulder pad according to a preferred embodiment of the present invention, as exemplified in FIGS. 19 and 20, it is worth mentioning that these protective components shown in these figures are preferably attached to other protective components using the same connectors (3,5) mentioned earlier.

The protective components attached to other protective components preferably comprise different preferred components and features, namely: a) a bridge (121)—collarbone and shoulder blade protector—removable; b) a bridge (123) connectable to chest protector in front and spine protector in back as well as to the frame along the inner edge—removable; c) a bridge (125) connectable to harness—removable; d) a bicep protector (81)—connectable to shoulder protector—fully removable; e) a removable moulded plastic and foam insert (127) for the bicep protector; and f) corresponding connectors (119).

Figure 21:
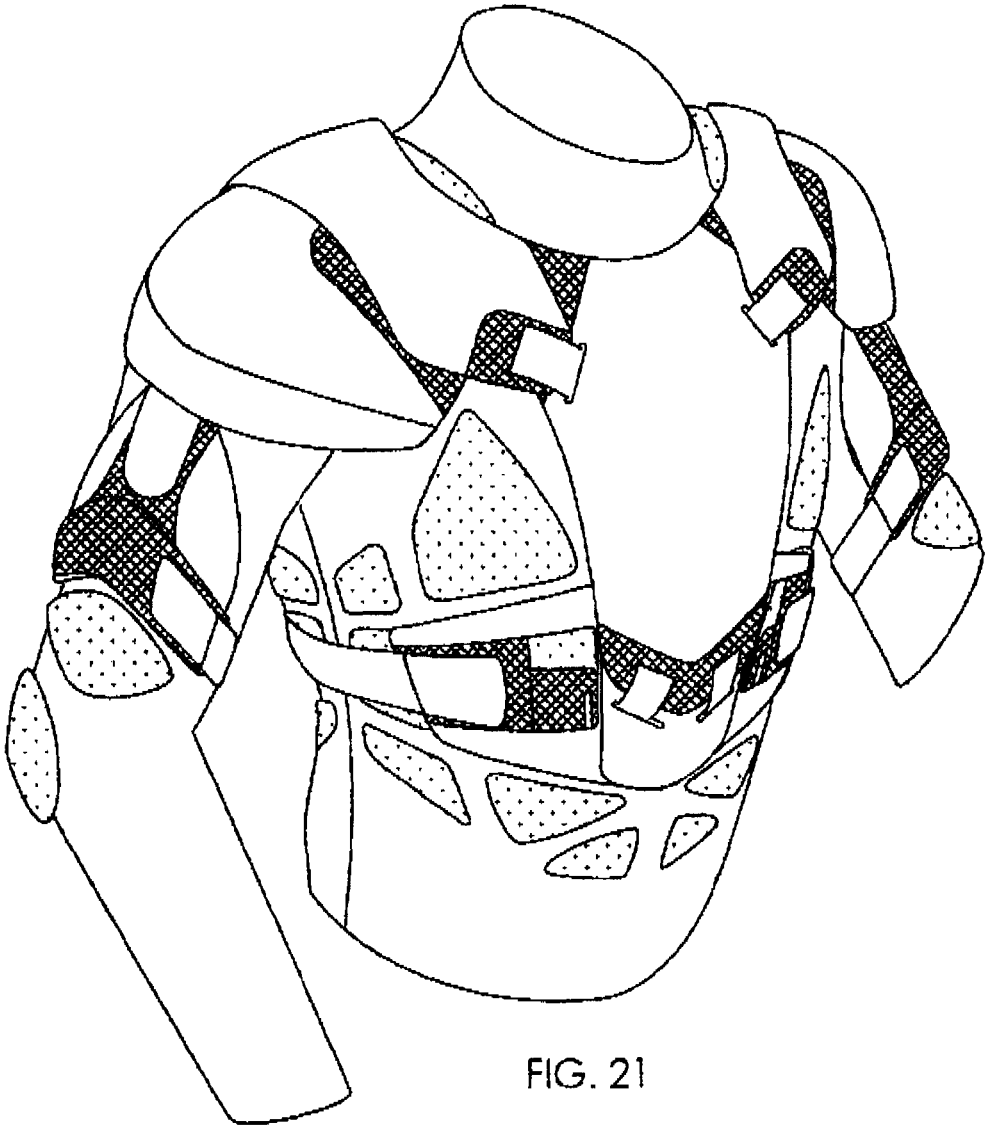

Regarding the complementary system according to the present invention, as exemplified in FIG. 21, it is worth mentioning that the modular shoulder pad and the protective undershirt base layer can be used together in order to compose a protective system. In the "complementary" system, the modular shoulder pad is simply worn over the protective undershirt base layer. The modular shoulder pad offers high impact floating protection where as the protective undershirt base layer offers a basic close-to-the-body non-obstructive protection, thus completing each other, working as an overall system, to offer improved protection over actual shoulder pads.

Furthermore, both the modular shoulder pad and the protective undershirt base layer are composed of removable protective parts that will allow the hockey player to customise the level of protection offered by the system.

When referring to FIG. 21 showing a perspective view of a modular shoulder pad over a protective undershirt base layer, according to a preferred embodiment of the present invention, it is worth mentioning that the modular shoulder pad is worn over the protective undershirt base layer, the system thus created offers improved coverage (ribs, shoulder blades, kidneys, spine, etc.) and better body motion over conventional shoulder pads due to the mix of close-to-the-body protection offered by the protective undershirt base layer and the floating protection offered by the modular shoulder pad, thus completing each other as a system or being functional as separate entities.

When referring to the integrated system according to the present invention, as exemplified in FIGS. 22*a*-26, it is worth mentioning that the modular shoulder pad and the protective undershirt base layer can be used together in order to create a corresponding complementary and adjustable protective system. This system is defined as "integrated" because the modular shoulder pad is directly attached and supported by the protective undershirt base layer. By integrating the modular shoulder pad to the protective undershirt base layer, one can further improve the overall fit and allow for a better body motion. The modular shoulder pad offers high impact floating protection where as the protective undershirt base layer offers a basic close-to-the-body non-obstructive protection, thus completing each other, working as an overall system, to offer improved protection over actual shoulder pads.

Furthermore, as previously discussed, both the modular shoulder pad and the protective undershirt base layer are composed of removable protective parts that will allow the player to customise the level of protection offered by the system.

Figure 22B:
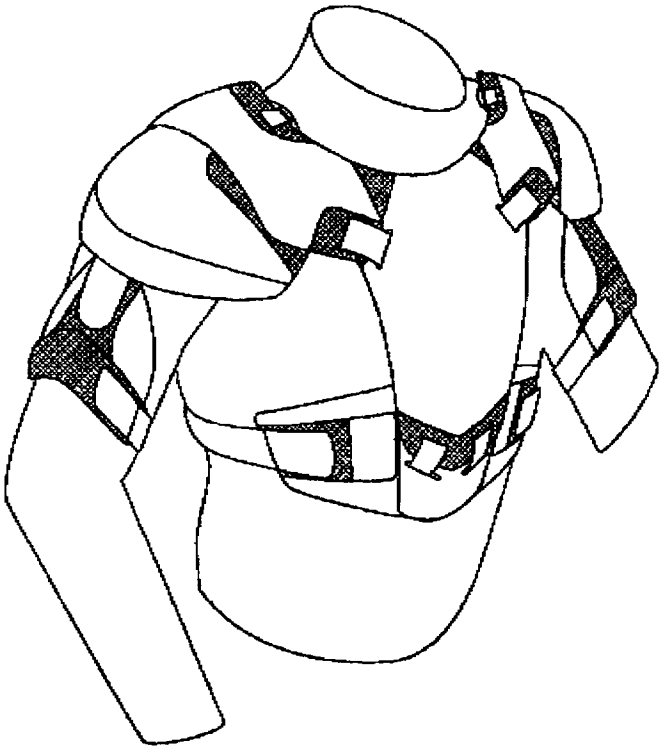
Figure 22A:
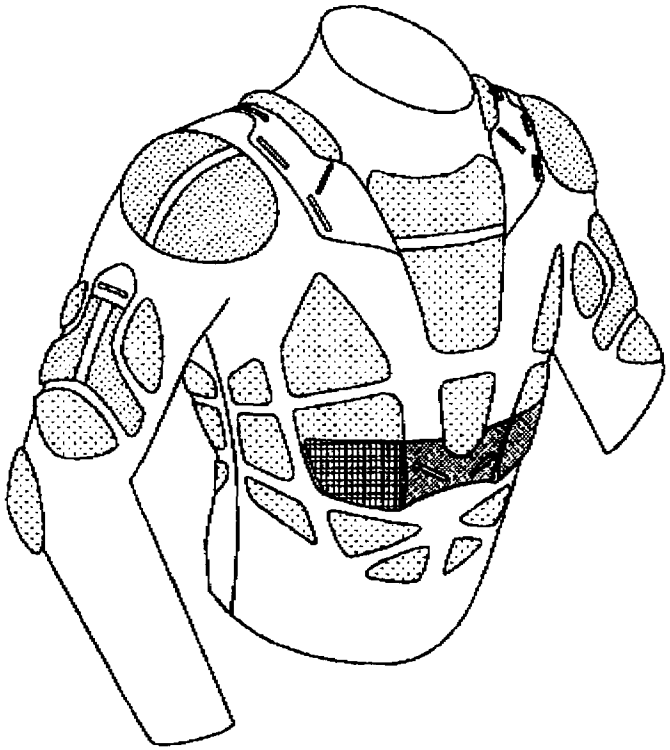
Figure 23:
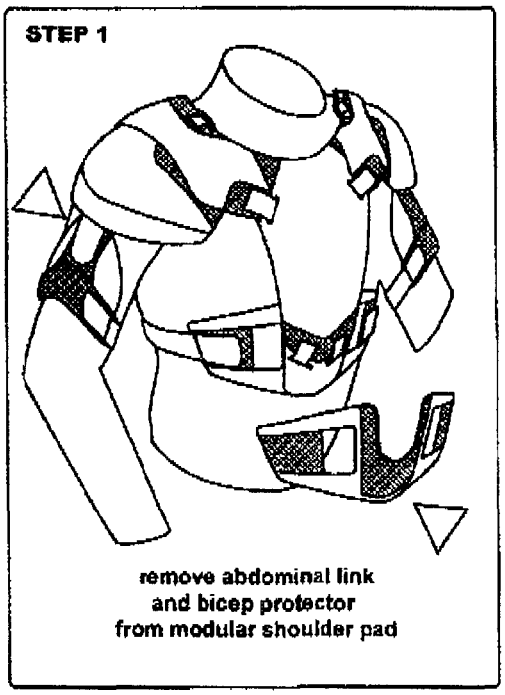
Figure 24:
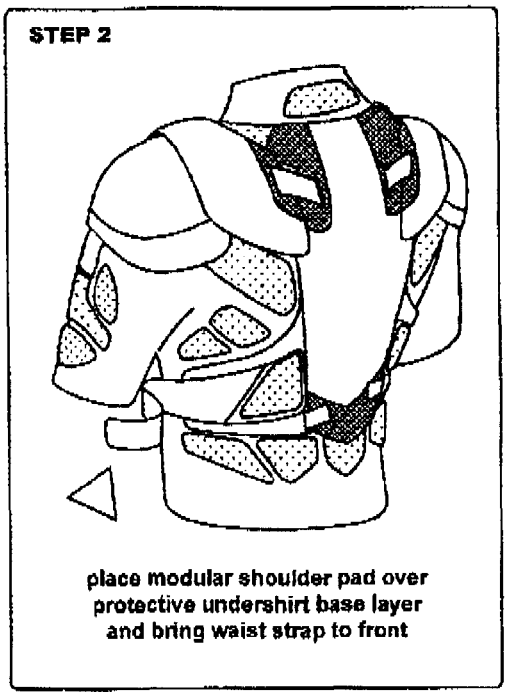
Figure 25:
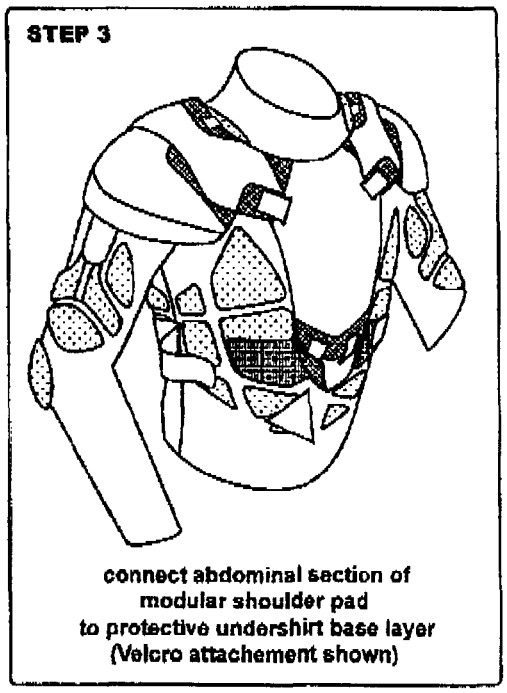
Figure 26:
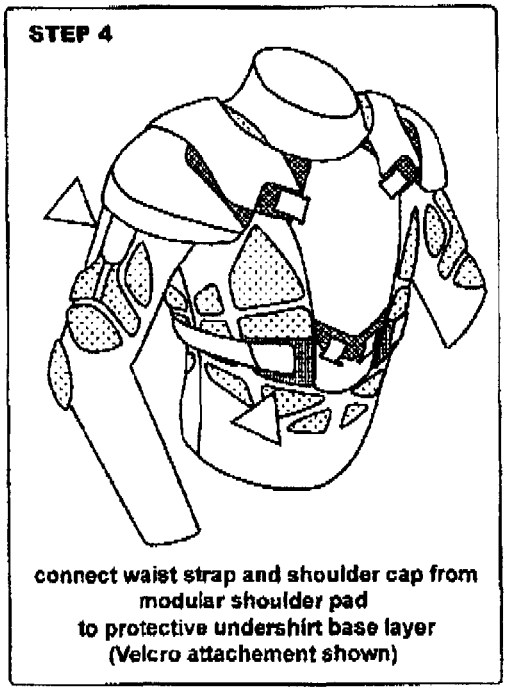
Figures 27, 28, 29, 30:
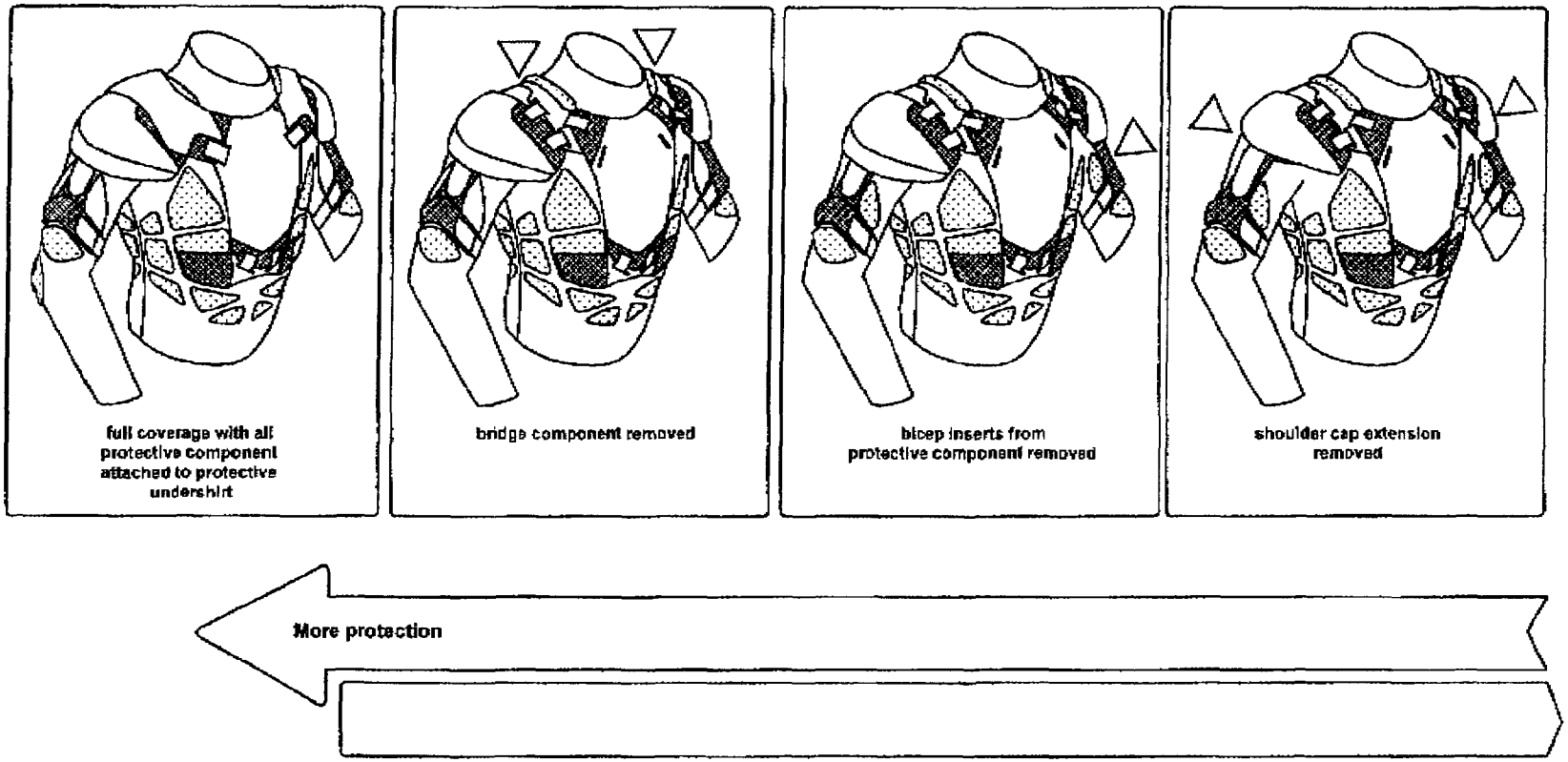
Figures 31, 32, 33, 34:
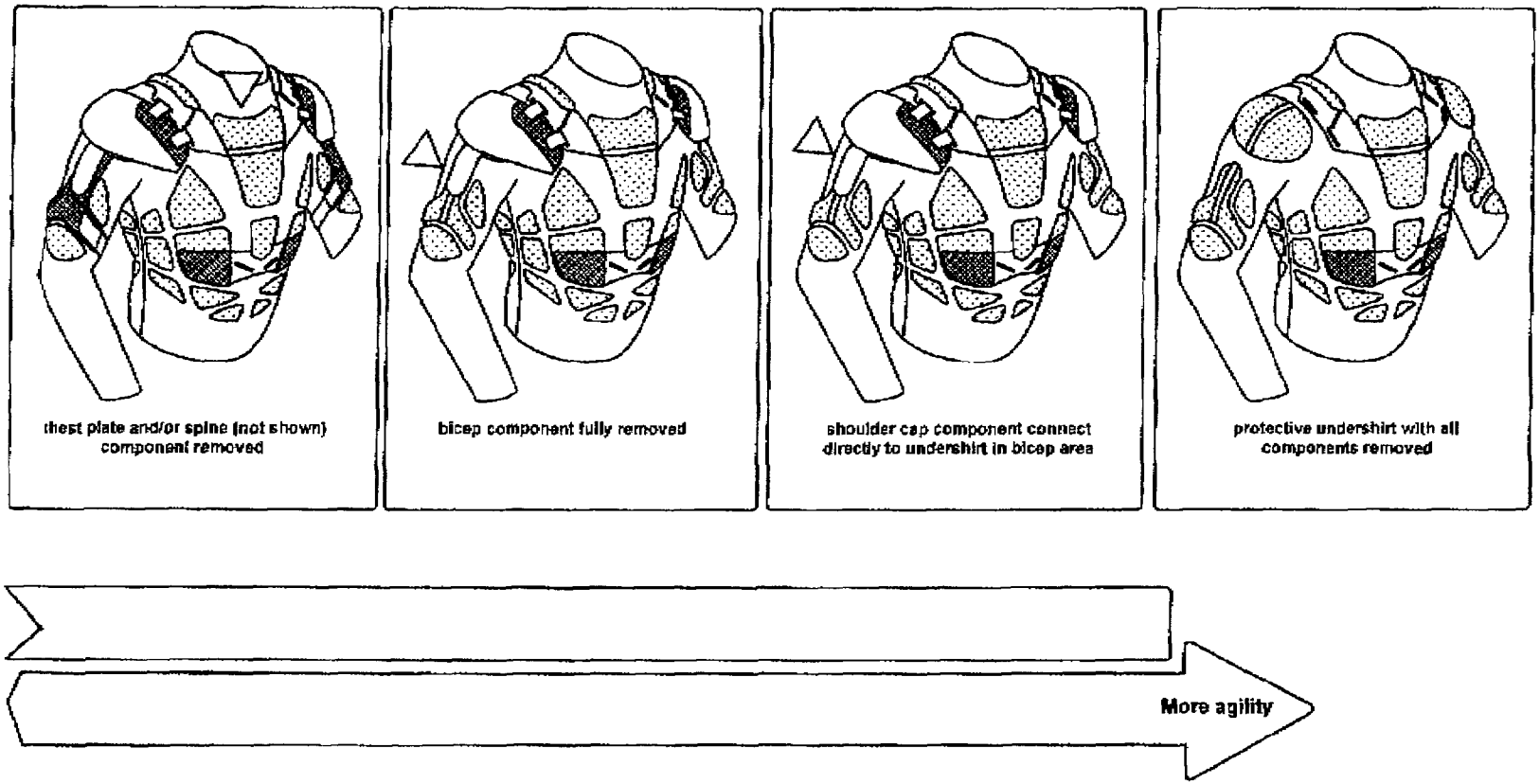

To better explain the relation between the modular shoulder pad and the protective undershirt base layer in the integrated system, the protective undershirt is illustrated in FIG. 22*a* and the modular shoulder pad in FIG. 22*b*.

In order to better understand how the integrated system works according to a preferred embodiment of the present invention, reference is made to FIGS. 23-26 where it can be seen that by removing the abdominal link from the modular shoulder pad harness, the modular shoulder pad can be integrated to the protective undershirt base layer through attachment points located on the protective undershirt base layer.

In regards to the transposition system according to a preferred embodiment of the present invention, as exemplified in FIGS. 27-35, it is to be understood that by "transposition" the protective components are removed from the modular shoulder pad and transposed directly to the protective undershirt base layer. Preferably also, the protective undershirt has anchoring points located at different positions such as the frame from the modular shoulder pad where the protective components can be directly attached as well.

FIGS. 27-34 exemplify a customizable level of protection possible according to a preferred embodiment of the present invention and an adjustment in terms of protection and/or agility depending on the particular configurations of the protective system, as per the user's wants and needs.

Figure 35:
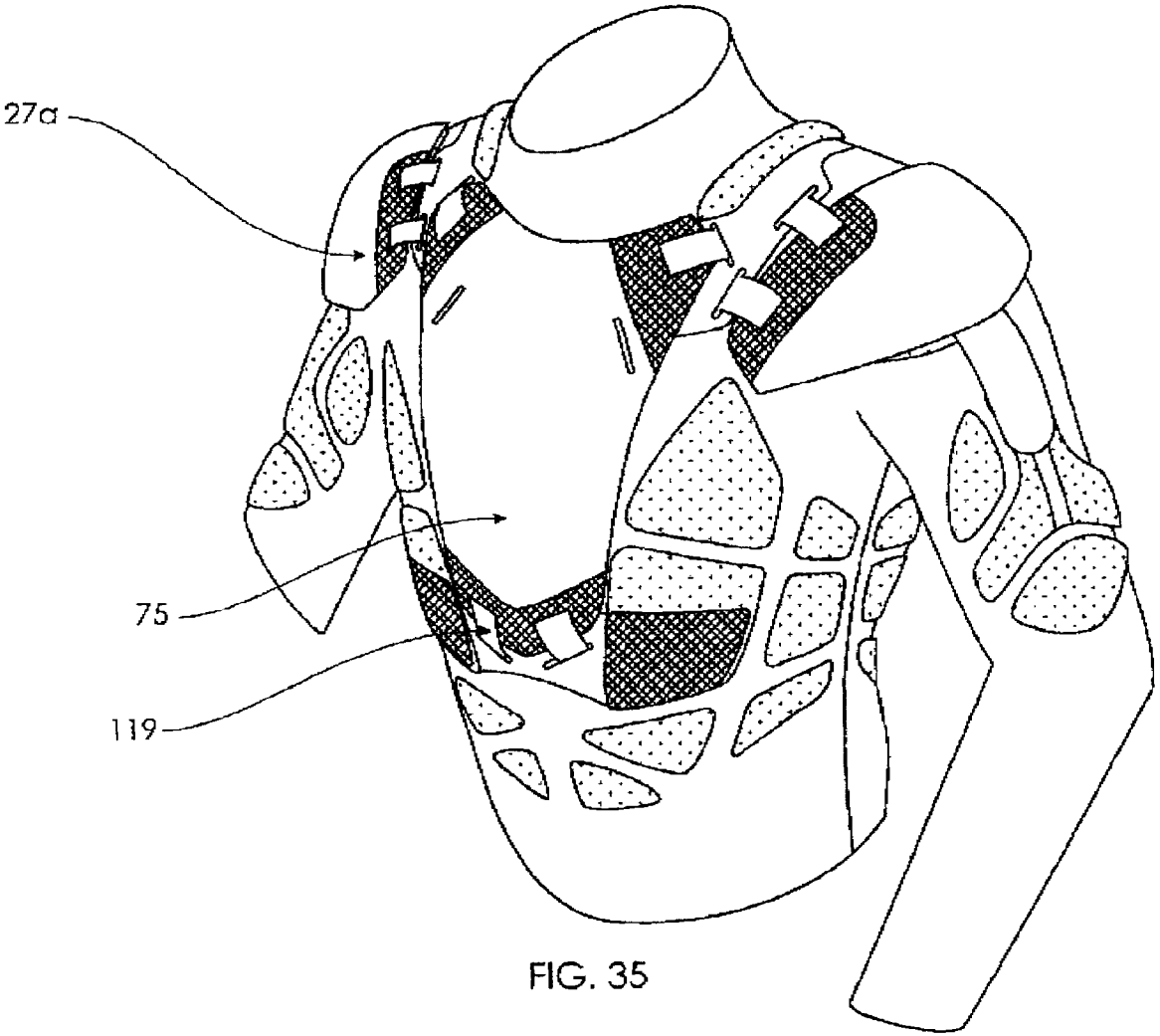
Figure 38:
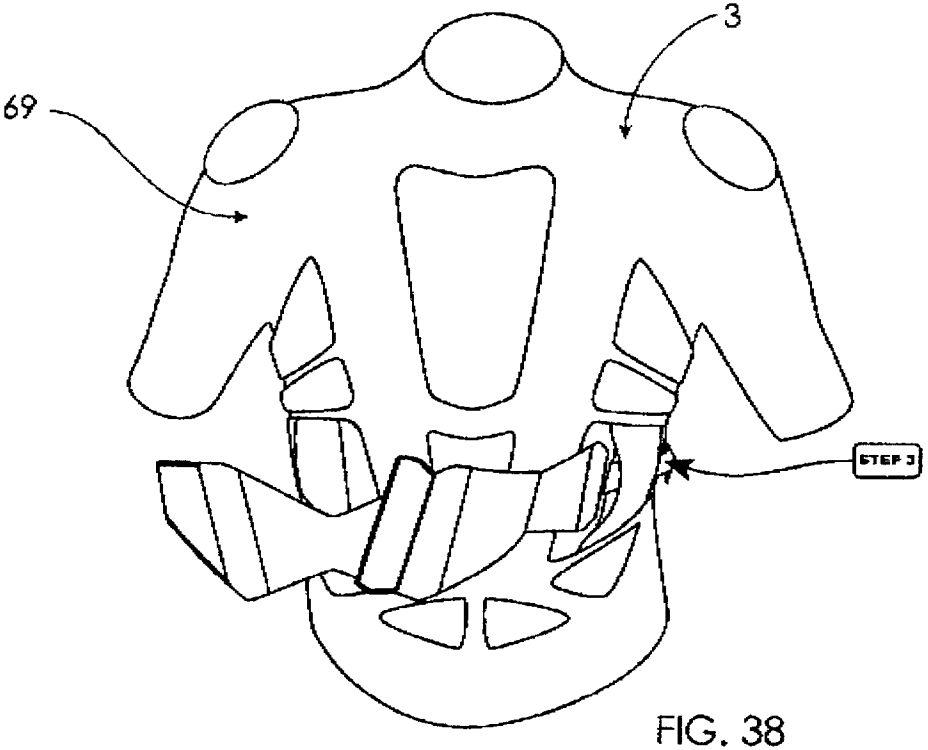

Referring now to FIG. 35, one can better see an exemplification of a transposition system according to a preferred embodiment of the present invention where there is shown an example of the thorax and shoulder cap protective parts originating from the modular shoulder pad attached to the protective undershirt anchor points with corresponding connectors.

Referring now to FIGS. 36-46, these show first how to connect the abdominal link (43) to the protective undershirt base layer (69) and second how to connect the frame of the modular shoulder pad to the abdominal link (43) to create the integrated system (1). With the integrated system, the removable abdominal link is connected permanently to the protective undershirt following steps 1 to 5 in FIGS. 36-40. It does not have to be removed from the protective undershirt every time by the player after the use of the protective equipment. The modular shoulder pad is worn and removed, before and after every use, following steps 6 to 10, exemplified in FIGS. 41-46.

Figure 40:
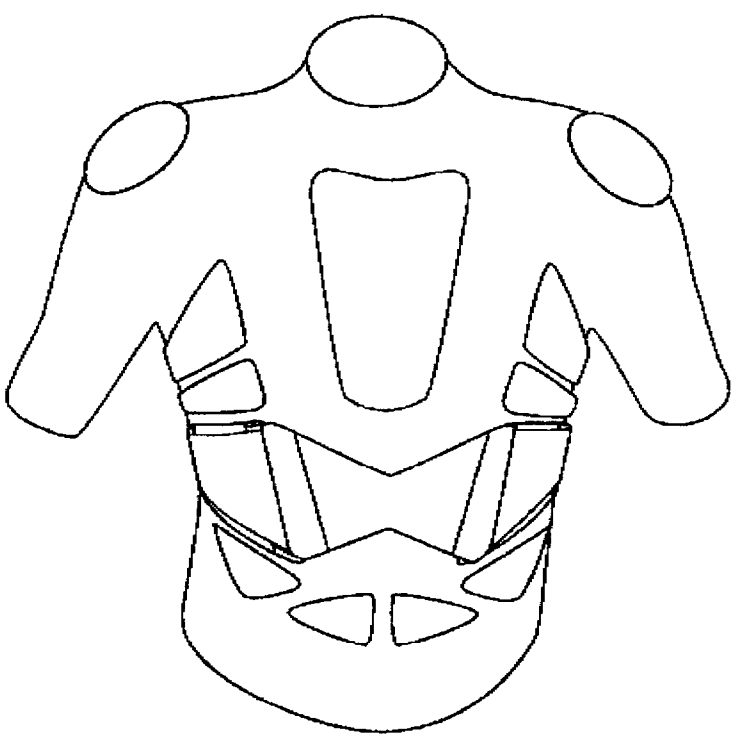
Figure 39:
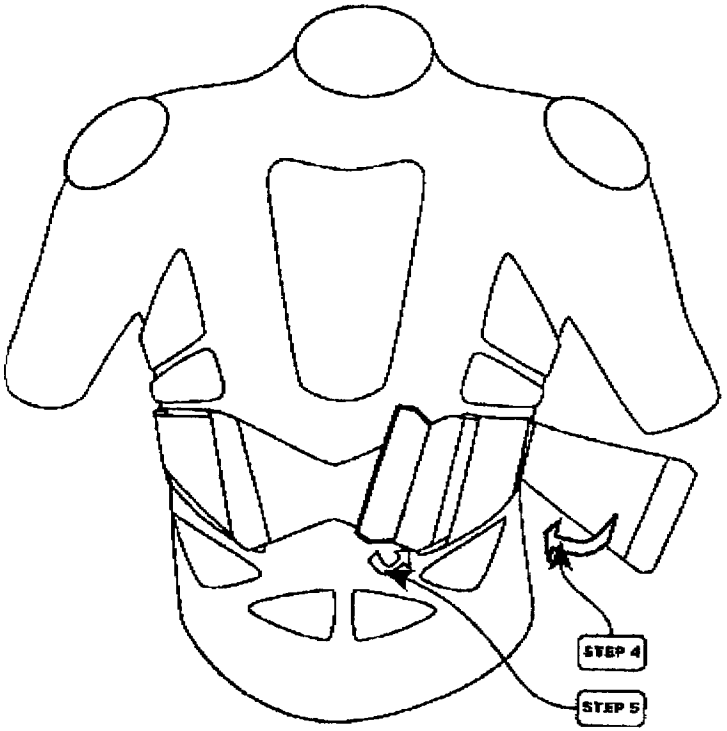

Referring now to the abdominal link to protective undershirt connection, according to a preferred embodiment of the present invention, as exemplified in FIGS. 39 and 40, this part of the system preferably comprises different preferred features and components, namely: a) an abdominal link (43) (removed from frame); b) foldable (43*c*) Velcro™ looping sections (43*c*); c) a Velcro™ lock tabs (129); d) a protective undershirt base layer (69); and e) integrated sleeves (61) each being opened at both ends.

Figure 42:
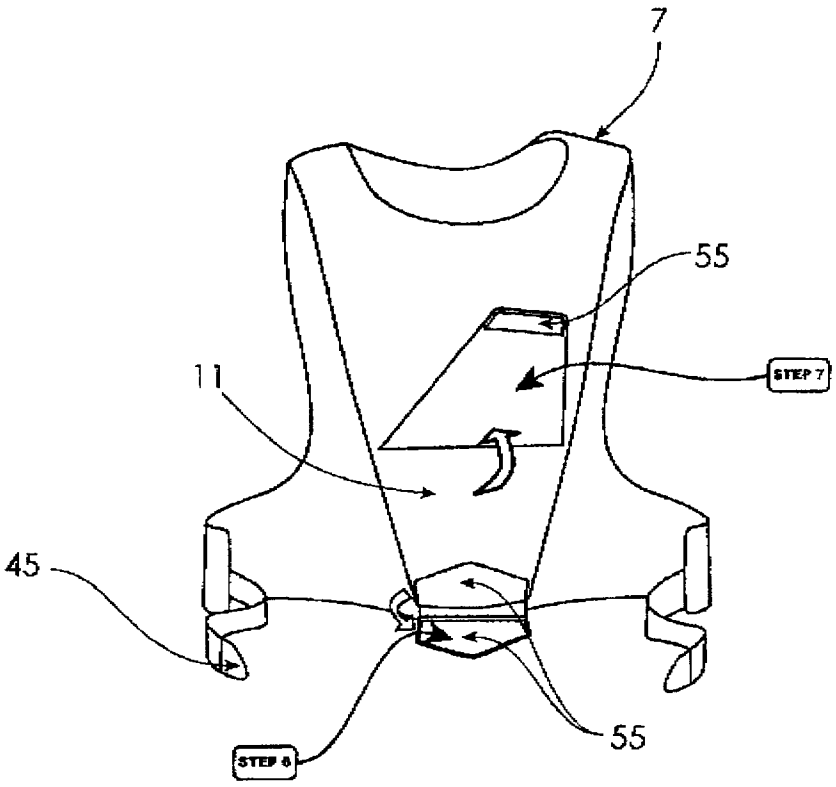
Figure 41:
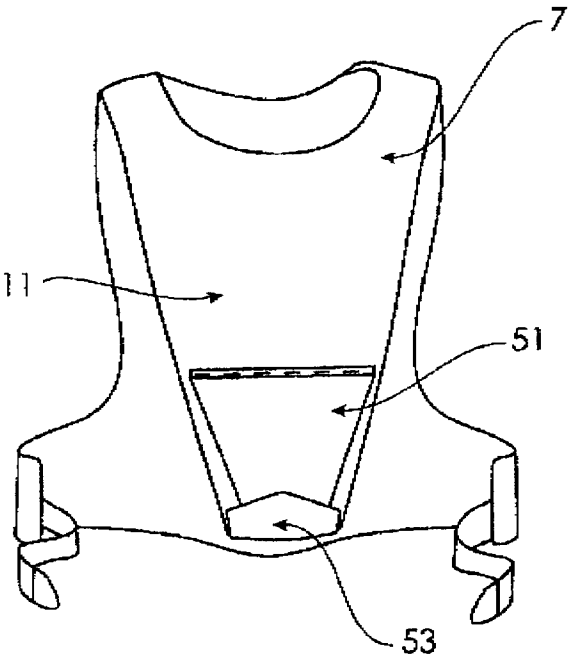

Regarding the frame connection to the integrated abdominal link according to a preferred embodiment of the present invention, as exemplified in FIGS. 41 and 42, this part of the system preferably comprises the following components and features, namely: a) an outer shell (7) or frame shown without removable protective components; b) a holding abdominal flap (51); c) a Velcro™ lock tab (53); d) a Velcro™ hook or loop securing assembly (55); and e) at least one waist strap (45).

Figure 44:
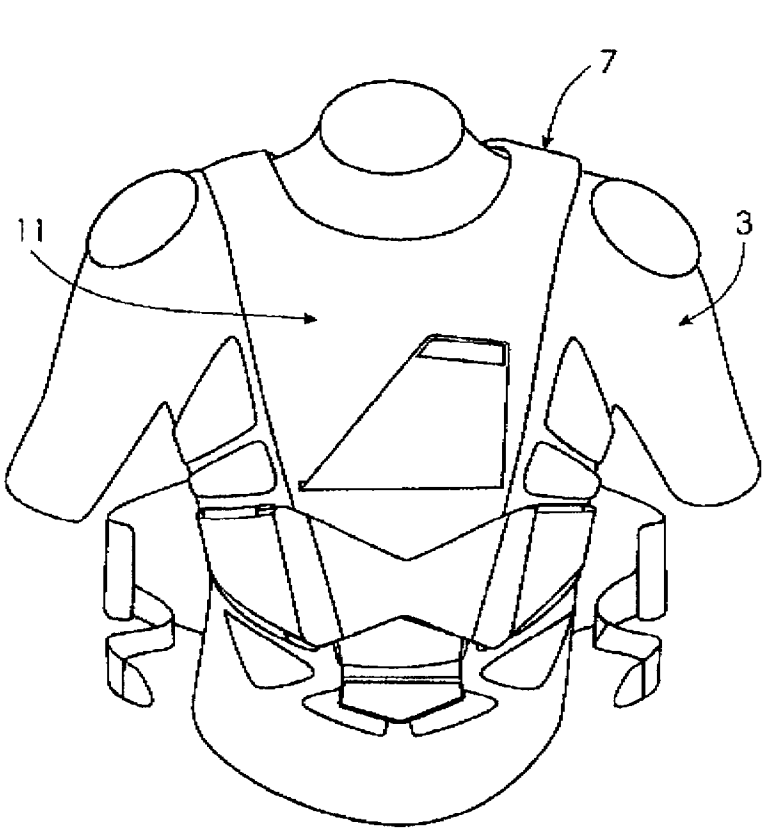
Figure 43:
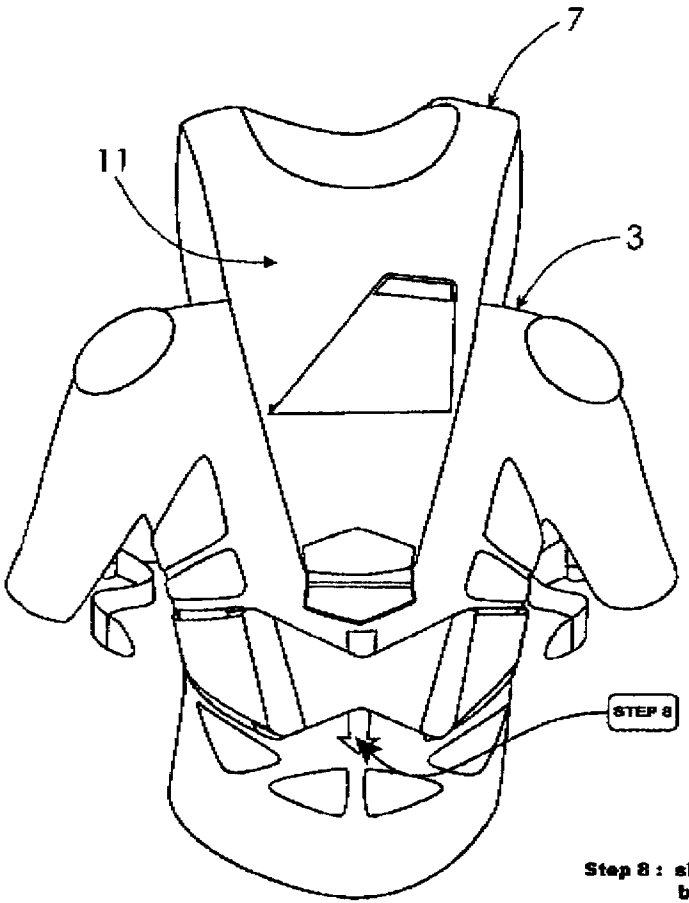

Referring to FIG. 44, there is shown a frame inserted between the protective undershirt and abdominal link according to a preferred embodiment of the present invention whereas in FIG. 46, there is shown an exemplification of a frame attached to the protective undershirt through abdominal link according to a preferred embodiment of the present invention.

Referring now to FIGS. 47-53, these show a preferred embodiment of a TPU connector designed to attach the removable shoulder cap to the modular shoulder pad or protective undershirt base layer. According to a preferred embodiment of the present invention, the TPU connector is preferably composed of two major elements: the TPU anchor (see FIGS. 48*a* and 48*b*) and the TPU band (see FIG. 49). The TPU anchor is first attached to one end of the TPU band, as exemplified in FIG. 50. Both TPU anchor and TPU band are then attached to the shoulder cap (27). Finally all three elements can be connected to the frame of the modular shoulder pad or to the protective undershirt with the TPU anchor.

Figure 49:
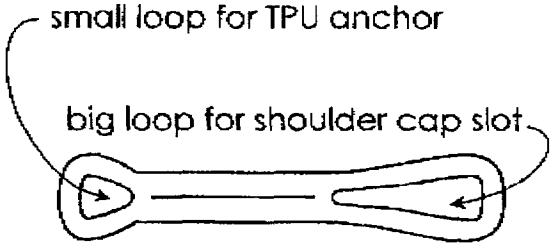
Figure 47:
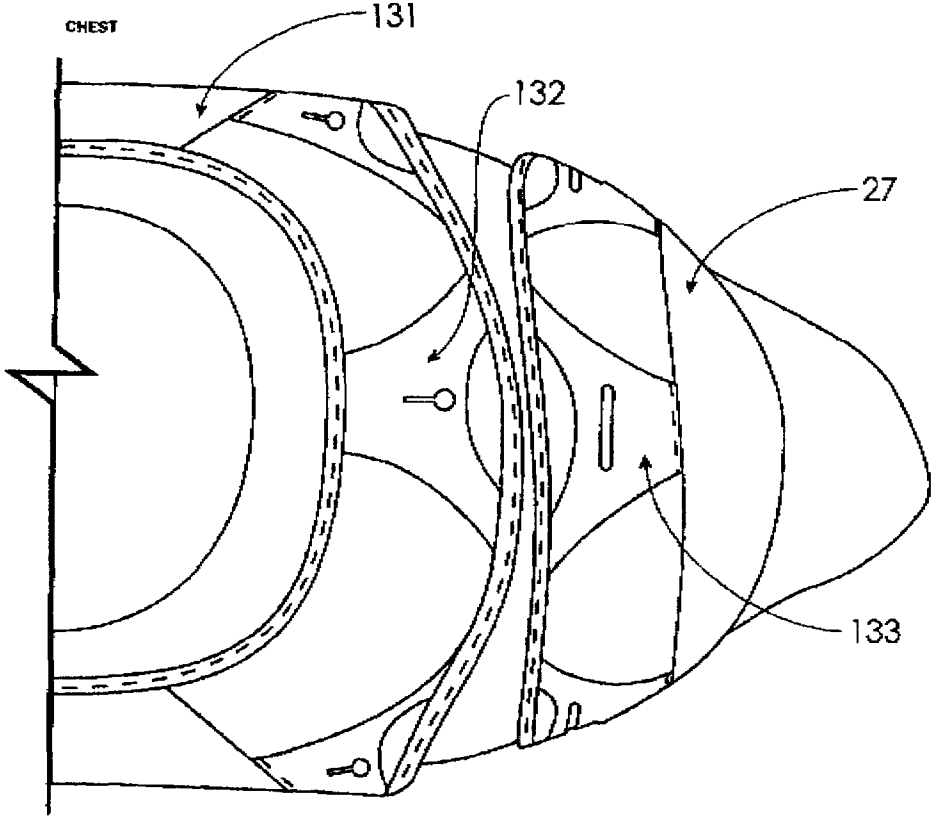
Figure 51:
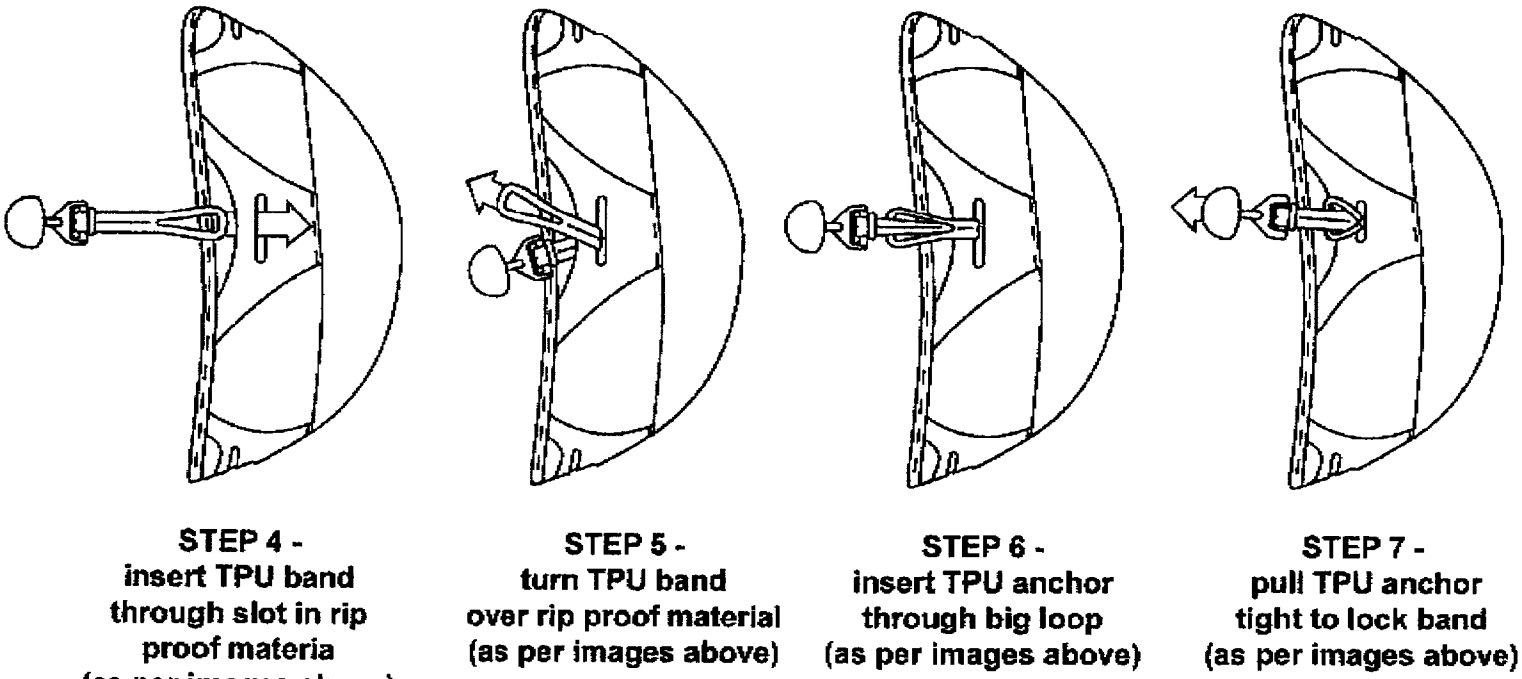
Figure 53:
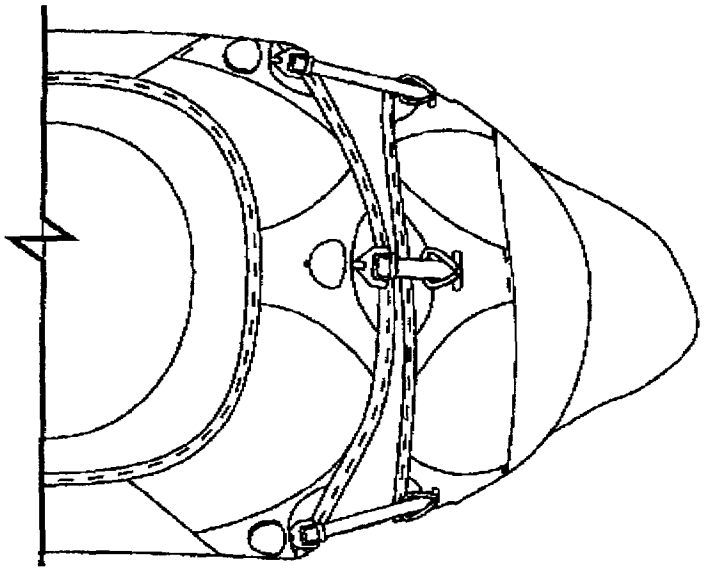
Figure 52:
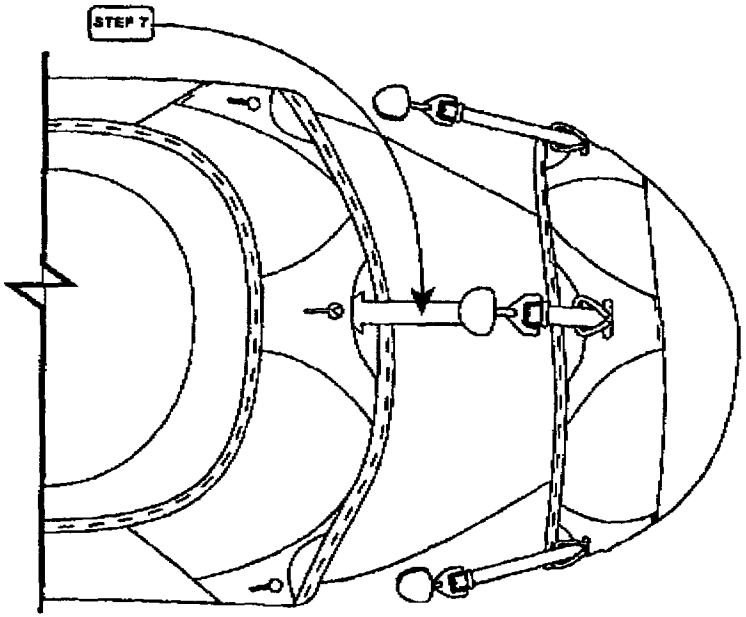
Figure 56:
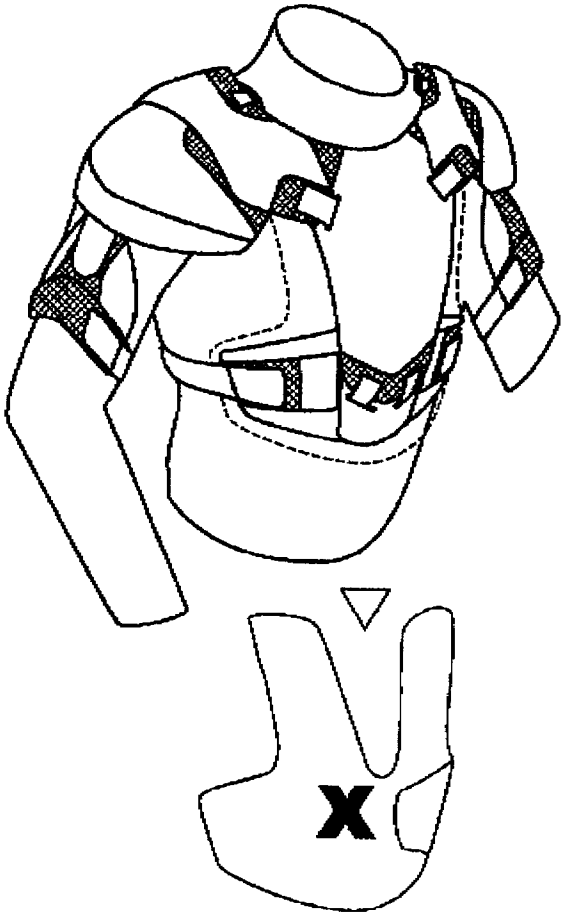
Figure 57:
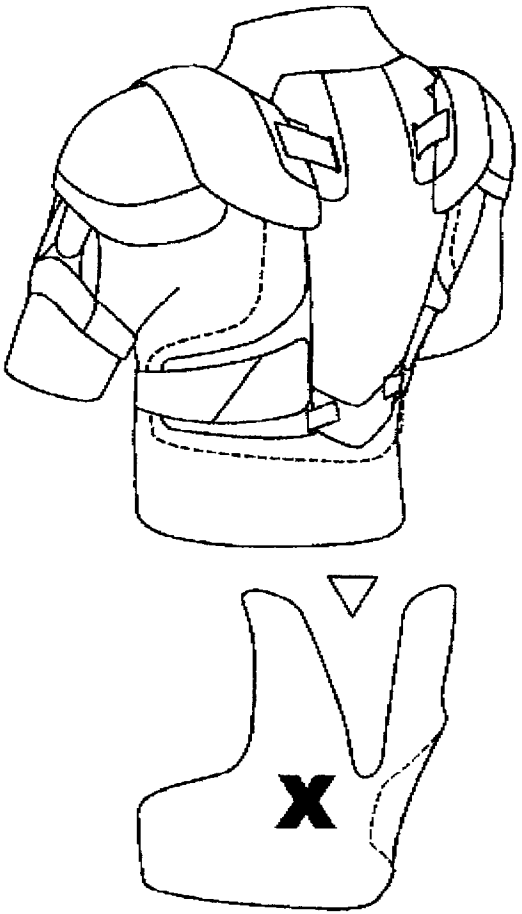

Referring now to FIGS. 47-49, there is shown an exemplification of shoulder cap connectors according to a preferred embodiment of the present invention, this part of the system preferably comprising the following components and features, namely: a) a chest section frame (131); b) a rip proof fabric overlay (132) with key hole for TPU anchor; c) a shoulder cap (27); and d) a rip proof fabric overlay (133) with slot for TPU elastic band.

It is worth mentioning that the TPU anchor may come in various lengths and tensions, depending on the particular applications and desired end results intended for the protective system (1), as can be easily understood by a person skilled in the art.

The protective system (1) and corresponding parts, as well as the resulting equipment, are preferably made of substantially rigid materials, such as hardened polymers, composite materials, polymeric materials, and/or the like, so as to ensure a proper operation thereof depending on the particular applications for which the protective system (1) is intended and the different parameters in cause, as apparent to a person skilled in the art.

As may now be better appreciated, upon reading the present brief description and when referring to accompanying drawings, the present invention is an improvement and presents several advantages over other conventional systems known in the prior art in that the present invention provides a new complementary and adjustable protective system that may be easily customized according to a users wants and/or needs, and/or other considerations, such as a degree of protection being sought, the extent of range of motion (freedom of movement) being desired, the particular type of sport to be played and/or the particular position to be played within said sport, etc.

Indeed, the base layer ensures an impact absorption on stable body parts while following body motion of the user, whereas the floating outer pad transfers the impact of the base layer while keeping freedom of motion for key articulations. The outer pad is typically worn on top of the base layer, following the same motion as one would do using a standard shoulder pad.

As explained hereinabove, the protective system (1) according to the present invention, including undershirt (3) and outer shell (7), may be used by a user along different operating modes, whether "complementary", "integrated" or "transposed". According to a preferred embodiment of the present invention, the stability of the outer pad is ensured by an integrated interlocking system, in addition to printed grip zones provided on the undershirt. The outer pad according to the present invention is also advantageous in that it preferably comprises thin and rigid plates covering each flex zone, these plates being connected to each other, and floating above the undershirt padding. The connection between the plates are preferably meant to be flexible and/or stretch, and as a result, the plates disperse the impact force to the absorption pads on the undershirt. The undershirt according to the present invention is also advantageous in that it provides padding which is integrated to the base layer creating an impact absorption layer. Some pads may be removable to create a recessed zone for outer pad fit. Key articulations are preferably surrounded with unpadded areas creating corresponding flex zones, each flex zone preferably enhancing the freedom of movement of the user, in addition to allowing heat and sweat to be released from the user. Other benefits resulting from the present invention reside in the following: a) an increased range of motion when compared to conventional shoulder pads; b) a lower profile look; c) an increased safety in that protection is intended to be always in the right place for the user; d) an increased protection coverage; and e) an overall lighter weight protective system.

The present invention is also advantageous in that due to the particular design of the overall system, the shoulder pad unit is able to have a reduced pad coverage and a reduced pad thickness when compared to standard shoulder pads, whereas the undershirt unit has an integrated padding system that complements or exceeds the reduced padding of the shoulder pad that goes over it.

The present system is also advantageous in that it provides a shoulder pad and an undershirt that complement each other, an important aspect of the present invention residing in reducing the protection of the shoulder pad while increasing the protection of the undershirt to create an overall protective system that maximizes the benefits of "dispersion" versus "absorption", as well as the two design protection approaches: "floating" and "close-to-the-body".

The present invention is also advantageous in that the aforementioned two units (i.e. shoulder pad and undershirt) are worn together creating an overall protective system which is not only complementary but also adjustable. Components can be selectively added to and/or removed from both the undershirt and the outer shoulder pad, so as to customize the overall system depending on a user's preferences and/or other considerations.

Of course, numerous modifications could be made to the above-described embodiments without departing from the scope of the invention, as defined in the appended claims.

The invention claimed is:

1. A protective system for protecting a user during a contact sport, the protective system comprising:

an undershirt configured to be worn by the user, the undershirt being provided with a plurality of shock-absorbing pads each being shaped and sized to protect different body parts of the user, each shock-absorbing pad providing a close-to-the-body protection for a corresponding body part of the user; and an outer shell configured to be worn by the user, over the undershirt, the outer shell being provided with a plurality of impact-dispersion pads each being shaped and sized to protect different body parts of the user, each impact-dispersion pad providing a floating protection for a corresponding body part of the user;

shock-absorbing pads of the undershirt being disposed so as to be complementary to impact-dispersion pads of the outer shell, and pads of either one of the undershirt and the outer shell being selectively customizable by a user, so as to provide the user with a complementary and adjustable protective system, a flap projecting from a frontal portion of the protective system;

a connecting link for operatively fastening the outer shell onto the user via the undershirt, the connecting link being mountable onto a bottom part of the frontal portion of the protective system;

a securing assembly for removably securing the tab onto the connecting link.

2. A protective system according to claim 1, wherein the outer shell comprises a frontal portion disposed along a substantially vertical axis, and defining a pair of front opened areas of the outer shell, each front opened area being provided on a corresponding side of the frontal portion.

3. A protective system according to claim 2, wherein the front opened areas of the outer shell are configured so as to be disposed about pectoral areas of the user, in order to allow a range of motion of the pectoral areas of the user within said front opened areas of the outer shell.

4. A protective system according to claim 2, wherein the frontal portion of the outer shell is tapered downwardly.

5. A protective system according to claim 2, wherein the frontal portion of the outer shell is substantially V-shaped.

6. A protective system according to claim 2, wherein the frontal portion of the outer shell is substantially T-shaped.

7. A protective system according to claim 2, wherein the frontal portion of the outer shell comprises an outer sternum shield.

8. A protective system according to claim 2, wherein the frontal portion of the outer shell comprises an inner pocket for selectively receiving therein a corresponding removable sternum foam pad.

9. A protective system according to claim 1, wherein the outer shell comprises a rear portion disposed along a substantially vertical axis, and defining a pair of rear opened areas of the outer shell, each rear opened area being provided on a corresponding side of the rear portion.

10. A protective system according to claim 9, wherein the rear opened areas of the outer shell are configured so as to be disposed about shoulder blade areas of the user, in order to allow a range of motion of the shoulder blade areas of the user within said rear opened areas of the outer shell.

11. A protective system according to claim 9, wherein the rear portion of the outer shell is substantially X-shaped.

12. A protective system according to claim 9, wherein the rear portion of the outer shell comprises an outer spine shield.

13. A protective system according to claim 9, wherein the rear portion of the outer shell comprises an inner pocket for selectively receiving therein a corresponding removable spine foam pad.

14. A protective system according to claim 1, wherein the outer shell comprises a pair of caps selected from the group consisting of clavicle caps, shoulder caps, bicep caps and shoulder blade cap.

15. A protective system according to claim 14, wherein at least one cap of the outer shell comprises a fastening assembly for fastening a corresponding cap about a corresponding arm portion of the user.

16. A protective system according to claim 1, wherein at least one pad of the undershirt is selectively removable therefrom so as to vary a degree of protection of the protective system.

17. A protective system according to claim 1, wherein at least one pad of the outer shell is selectively removable therefrom so as to vary a degree of protection of the protective system.

18. A protective system according to claim 1, wherein the undershirt comprises at least one pocket for receiving a corresponding removable pad therein.

19. A protective system according to claim 1, wherein the outer shell comprises at least one pocket for receiving a corresponding removable pad therein.

20. A protective system according to claim 1, wherein at least one pad of the undershirt is configured to be interchangeable with at least one pad of the outer shell, and vice-versa.

21. A protective system according to claim 1, wherein first and second pockets provided respectively on the undershirt and the outer shell have substantially the same shape and substantially the same size so that a corresponding pad configured for removably inserting into the first pocket of the undershirt may be removably insertable into the second pocket of the outer shell, and vice-versa.

22. A protective system according to claim 21, wherein the corresponding pad is a removable sternum foam pad.

23. A protective system according to claim 21, wherein the corresponding pad is a removable spine foam pad.

24. A protective system according to claim 1, wherein the undershirt comprises a pair of pads defining a space between said pads, said space being configured so that a corresponding pad of the outer shell is insertable into the space when the outer shell is mounted onto the undershirt, for providing a mechanical lock between the undershirt and the outer shell.

25. A protective system according to claim 24, wherein the space is configured for receiving a corresponding sternum foam pad of the outer shell.

26. A protective system according to claim 1, wherein the outer shell comprises a pair of pads defining a space between said pads, said space being configured so that a corresponding pad of the undershirt be insertable into the space when the outer shell is mounted onto the undershirt, for providing a mechanical lock between the undershirt and the outer shell.

27. A protective system according to claim 1, wherein the undershirt comprises both removable pads and integrated pads.

28. A protective system according to claim 27, wherein each removable pad of the undershirt is selected from the group consisting of a removable sternum pad, a removable top spine pad, a removable shoulder pad, a removable bicep pad, a removable front rib pad and a removable back rib pad.

29. A protective system according to claim 27, wherein each integrated pad of the undershirt is selected from the group consisting of an integrated molded shoulder pad, an integrated molded bicep pad, an integrated front rib pad, an integrated back rib pad, an integrated chest pad, an integrated abdominal pad and an integrated lower back pad and an integrated shoulder blade pad.

30. A protective system according to claim 1, wherein the undershirt comprises at least one flex zone.

31. A protective system according to claim 30, wherein each flex zone is selected from the group consisting of a clavicle flex zone, a shoulder flex zone, a bicep flex zone, a pectoral flex zone, a scapular flex zone, a shoulder blade flex zone and a tricep flex zone.

32. A protective system according to claim 30, wherein each flex zone is provided by a corresponding zone of the undershirt made of a corresponding meshed material.

33. A protective system according to claim 1, wherein the impact-dispersion pads of the outer shell comprise at least one substantially rigid plate configured to cover each flex zone of the undershirt when the outer shell is worn over said undershirt.

34. A protective system according to claim 33, wherein each pair of substantially rigid plates of the outer shell are interconnected by a substantially flexible stretch connection.

35. A protective system according to claim 1, wherein the outer shell comprises at least one stretch connection selected from the group consisting of a clavicle-to-shoulder blade stretch connection, a clavicle-to-sternum stretch connection and a shoulder blade-to-spine stretch connection.

36. A protective system according to claim 1, wherein the protective system comprises a pair of straps, each strap originating from a corresponding side of a rear portion of the outer shell and having an extremity being selectively securable onto a corresponding wing section of the connecting link on the frontal portion of the outer shell by fastening assembly.

37. A protective system according to claim 1, wherein the connecting link comprises a pair of wing sections each projecting out from a corresponding side of a bottom part of a frontal portion of the outer shell, in a direction substantially transverse to that of the frontal portion.

38. A protective system according to claim 1 wherein wing sections of the connecting link are removably insertable into a pair of corresponding sleeves provided on a frontal portion of the undershirt, for selectively interconnecting the outer shell to the undershirt via the connecting link.

39. A protective system according to claim 1, wherein the connecting link comprises:

a central section;

a pair of wing sections, each wing section projecting out from a corresponding side of the central section; and a pair of looping sections, each looping section projecting out from a corresponding side of a given wing section, and being foldable about a given sleeve when said given wing section is inserted therein so as to be removably secured back onto a connecting portion of the central section via a corresponding securing assembly.

40. A protective system according to claim 39, wherein the central portion of the connecting link comprises upper and lower recessed segments.

41. A protective system according to claim 1, wherein the undershirt comprises at least one anchor for selectively interconnecting the outer shell to the undershirt.

42. A protective system according to claim 41, wherein said at least one anchor comprises at least one sleeve provided on the undershirt.

43. A protective system according to claim 42, wherein said at least one sleeve comprises a pair of sleeves, each sleeve being provided on either side of a central portion of the undershirt.

44. A protective system according to claim 42, wherein each sleeve is configured for receiving a corresponding wing section of a connecting link of the protective system.

45. A protective system according to claim 42, wherein each sleeve is made of a stretchable material.

46. A protective system according to claim 1, wherein the connecting link is an abdominal link.

47. A protective system according to claim 46, wherein the abdominal link is selectively removable from the outer shell, and comprises:

a central section;

a pair of wing sections, each wing section projecting out from a corresponding side of the central section; and a pair of looping sections, each looping section projecting out from a corresponding side of a given wing section, and being foldable about a given sleeve when said given wing section is inserted therein so as to be removably secured back onto a connecting portion of the central section via a corresponding securing assembly; and wherein the abdominal link is removably mountable onto a pair of sleeves of the undershirt, so as to serve as an anchoring link for selectively interconnecting a frontal portion of the outer shell onto the undershirt via a corresponding flap-tab assembly.

48. A protective system according to claim 1, wherein portions of the undershirt are provided with printed grip zones for gripping corresponding portions of the outer shell when placed over the undershirt.

49. A protective system according to claim 1, wherein the protective system comprises a base liner removably mountable onto the outer shell.

50. A protective system according to claim 49, wherein the base liner is removably mountable onto the outer shell by a connecting link.

* * * * *